US007263299B2

(12) United States Patent
Nagamochi et al.

(10) Patent No.: US 7,263,299 B2
(45) Date of Patent: Aug. 28, 2007

(54) IMAGE FORMING APPARATUS THAT JUDGES LIFETIME OF PHOTOSENSITIVE UNIT

(75) Inventors: Katsuya Nagamochi, Tokyo (JP); Yoshikatsu Kamisuwa, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 197 days.

(21) Appl. No.: 10/985,893

(22) Filed: Nov. 12, 2004

(65) Prior Publication Data

US 2006/0104649 A1 May 18, 2006

(51) Int. Cl.
*G03G 15/00* (2006.01)
*G03G 21/00* (2006.01)

(52) U.S. Cl. ..... 399/26; 399/48; 399/55

(58) Field of Classification Search ..... 399/26, 399/24, 48, 81, 53, 55, 116; 324/452, 457
See application file for complete search history.

(56) References Cited

U.S. PATENT DOCUMENTS 5,404,201 A * 4/1995 Umeda et al. ..... 399/26 X
2003/0016961 A1* 1/2003 Kitajima ..... 399/50
2006/0127107 A1 6/2006 Kamisuwa et al.

FOREIGN PATENT DOCUMENTS

| | | | |
|---|---|---|---|
| JP | 63-133166 A | * | 6/1988 |
| JP | 5-100517 A | | 4/1993 |
| JP | 05-323841 A | * | 12/1993 |
| JP | 9-190120 A | | 7/1997 |
| JP | 2000-347545 A | | 12/2000 |
| JP | 2002-82578 A | | 3/2002 |

* cited by examiner

*Primary Examiner*—Sophia S. Chen
(74) *Attorney, Agent, or Firm*—Foley & Lardner LLP

(57) ABSTRACT

The residual potential and charging potential of the surface of a photosensitive drum 20, or the charging potential and exposure potential of the surface of the photosensitive drum 20 are detected by an exposure sensor 28. The lifetime of the photosensitive drum 20 is judged in accordance with the difference between the detected charging potential and residual potential, or the difference between the detected charging potential and exposure potential.

12 Claims, 28 Drawing Sheets

IMAGE FORMING APPARATUS THAT JUDGES LIFETIME OF PHOTOSENSITIVE UNIT

BACKGROUND OF THE INVENTION

1. Field of the Invention

The present invention relates to an image forming apparatus comprising a photosensitive unit.

2. Description of the Related Art

In an image forming apparatus such as a copying machine, an image of a document set on a document base is optically read, an electrostatic latent image corresponding to the read image is formed on the surface of a photosensitive drum, and the electrostatic latent image is developed (visualized) by a developer (toner and carrier) and printed on a paper sheet. The electrostatic latent image on the photosensitive drum is formed by a laser beam emitted from an exposure unit.

A developing roller, developer, paper sheet, and cleaning unit blade are brought into contact with the surface of the photosensitive drum. As a result of this contact, the characteristics of the surface of the photosensitive drum change with time, and it eventually becomes impossible to form an appropriate image. That is, the photosensitive drum has a limited life.

Therefore, the lifetime of the photosensitive drum is judged based on the number of printed paper sheets, and an expired photosensitive drum needs to be replaced with a new photosensitive drum.

However, there are various forms in image formation. Therefore, it is difficult to exactly judge the lifetime only by the number of printed paper sheets.

On the other hand, as a method for judging the lifetime of the photosensitive drum, there has been an example described in Jpn. Pat. Appln. KOKAI Publication No. 2002-82578. In this example, the photosensitive drum is charged and exposed, the charging potential and exposure potential of the photosensitive drum at this time are detected, and the charging potential and exposure potential are corrected in such a manner that the difference between both detected potentials is constant. The time at which to change the photosensitive drum is predicted based on these corrected amounts. It is to be noted that in the above-described publication, a method in which the time at which to change the photosensitive drum is predicted from the operation time of the drum, and a method in which the time at which to change the photosensitive drum is predicted from the operation time of the developing roller brought into contact with the drum have also been described.

However, in the method in which the charging and exposure potentials are corrected, respectively, to thereby predict the change time, a long time is required in the correction. Therefore, there is a problem that a long time is required for the judgment of the lifetime of the photosensitive drum. Since there are various forms in the image formation, it is difficult to exactly judge the lifetime only by the operation time of the photosensitive drum or the developing roller.

BRIEF SUMMARY OF THE INVENTION

An object of the present invention is to provide an image forming apparatus capable of quickly and exactly judging the lifetime of the photosensitive unit.

According to the present invention, there is provided an image forming apparatus comprising:

a photosensitive unit;

a static eliminator unit which eliminates static electricity from the surface of the photosensitive unit;

a charging unit which charges the surface of the photosensitive unit subjected to static elimination by the static eliminator unit;

an exposure unit which exposes the surface of the photosensitive unit charged by the charging unit;

a developing unit which develops the surface of the photosensitive unit exposed by the exposure unit;

a potential sensor which detects a residual potential of the surface of the photosensitive unit subjected to static elimination by the static eliminator unit, a charging potential of the surface of the photosensitive unit charged by the charging unit, and an exposure potential of the surface of the photosensitive unit exposed by the exposure unit;

detection means for detecting a difference between the charging potential detected by the potential sensor and the residual potential detected by the potential sensor, or a difference between the charging potential detected by the potential sensor and the exposure potential detected by the potential sensor; and judgment means for judging a lifetime of the photosensitive unit in accordance with the difference detected by the detection means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiment of the invention, and together with the general description given above and the detailed description of the preferred embodiments given below, serve to explain the principles of the invention.

DETAILED DESCRIPTION OF THE INVENTION

[1] A first embodiment of the present invention will be described hereinafter with reference to the drawings.

Figure 1:
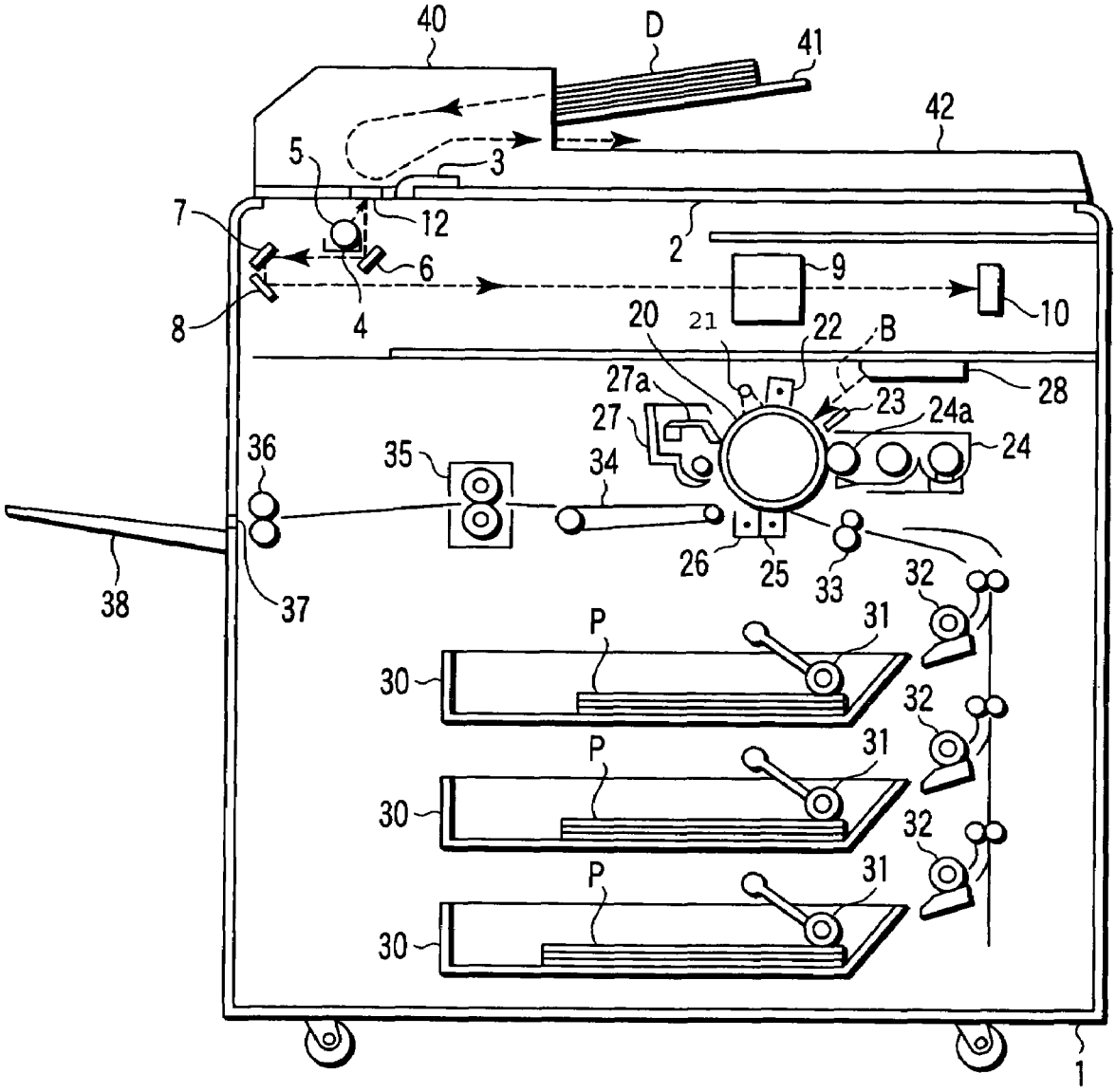
FIG. 1 is a diagram showing an internal constitution of each embodiment.

As shown in FIG. 1, a transparent document base (glass plate) 2 for laying a document is disposed in an upper surface portion of a main body 1. An indicator 3 is disposed on one side portion of the document base 2. A stepped portion between the indicator 3 and the document base 2 corresponds to a reference position for setting the document.

A carriage 4 is disposed under the document base 2, and an exposure lamp 5 is disposed on the carriage 4. The carriage 4 is movable (reciprocating movement) along the lower surface of the document base 2. While the carriage 4 reciprocates along the document base 2, the exposure lamp 5 turns on, and accordingly the document laid on the document base 2 is exposed.

A reflected light image from the document is obtained by the exposure, and projected onto a charge coupled device (CCD) 10 by reflective mirrors 6, 7, 8, and a variable power lens block 9. The CCD 10 outputs an image signal corresponding to the projected image.

The image signal output from the CCD 10 is digitized, and the digital signal is supplied to an exposure unit 28. The exposure unit 28 emits a laser beam B in response to an input signal.

A window 12 for reading the document is disposed in the vicinity of the indicator 3. An automatic document feeder (ADF) 40 which also serves as a document base cover is openably disposed over the document base 2, indicator 3, and window 12. The automatic document feeder 40 has a tray 41 for laying documents, feeds a plurality of documents D set on the tray 41 to the window 12 sheet by sheet so that the documents pass on the window 12, and discharges the passed documents D to a tray 42. When the automatic document feeder 40 operates, the exposure lamp 5 emits light in a position facing the window 12, and the light is applied to the window 12. The light applied to the window 12 is applied to the document D on the window 12. The reflected light image from the document D is obtained by this irradiation, and projected onto the CCD 10 by the reflective mirrors 6, 7, 8 and variable power lens block 9.

On the other hand, a rotary photosensitive unit, for example, a photosensitive drum 20 is disposed in the vicinity of the exposure unit 28. A static eliminator unit 21, a charging unit 22, a potential sensor 23, a developing unit 24, a transfer unit 25, a peeling unit 26, and a cleaning unit 27 are successively arranged around the photosensitive drum 20. A laser beam B emitted from the exposure unit 28 passes between the charging unit 22 and the potential sensor 23, and is applied to the surface of the photosensitive drum 20.

The static eliminator unit 21 applies light of a lamp or a light emitting diode to the photosensitive drum 20, and accordingly removes an electric charge remaining on the surface of the photosensitive drum 20 (static elimination). The charging unit 22 applies a high-level voltage to the photosensitive drum 20 to thereby supply a static charge to the surface of the photosensitive drum 20. The surface of the photosensitive drum 20 charged in this manner is exposed by the laser beam B of the exposure unit 28, and accordingly an electrostatic latent image is formed on the surface of the photosensitive drum 20. It is to be noted that the charging unit 22 has a grid 22*a* for adjusting a charging output with respect to the photosensitive drum 20.

The potential sensor 23 detects the potential of the surface of the photosensitive drum 20 in a non-contact state. Concretely, the potential sensor 23 detects a residual potential remaining on the surface of the photosensitive drum 20 subjected to the static elimination by the static eliminator unit 21, a charging potential of the surface of the photosensitive drum 20 charged by the charging unit 22, and an exposure potential of the surface of the photosensitive drum 20 exposed by the exposure unit 28, respectively.

The developing unit 24 has a developing roller 24*a* which rotates contacting the surface of the photosensitive drum 20, and supplies a developer (toner and carrier) stored beforehand to the surface of the photosensitive drum 20 by the developing roller 24*a*. Accordingly, the electrostatic latent image on the surface of the photosensitive drum 20 is developed to thereby form a visual image. The transfer unit 25 transfers the visual image on the surface of the photosensitive drum 20 to a paper sheet P supplied from resist rollers 33 described later. The peeling unit 26 peels the paper sheet P passed through the transfer unit 25 from the photosensitive drum 20. The cleaning unit 27 has a blade 27*a* brought into contact with the surface of the photosensitive drum 20, and removes the residual developer or the like from the surface of the photosensitive drum 20.

A plurality of sheet cassettes 30 are arranged in a lower part of the main body 1. A large number of paper sheets P having mutually different sizes are stored in these sheet cassettes 30. The paper sheets P are taken out of one of the sheet cassettes 30 sheet by sheet. To take out the sheets, pickup rollers 31 are disposed. The taken-out paper sheets P are separated from the sheet cassettes 30 by separation rollers 32, and sent to the resist rollers 33. The resist rollers 33 feed the paper sheet P between the photosensitive drum 20 and the transfer unit 25 at a timing in consideration of rotation of the photosensitive drum 20.

The paper sheet P peeled from the photosensitive drum 20 is sent to a fixing unit 35 by a conveying belt 34. The fixing unit 35 fixes the transferred image on the paper sheet P by heat. The fixed paper sheet P is sent to a discharge port 37 by discharge rollers 36, and discharged to a tray 38 outside the main body 1 via the discharge port 37.

Figure 2:
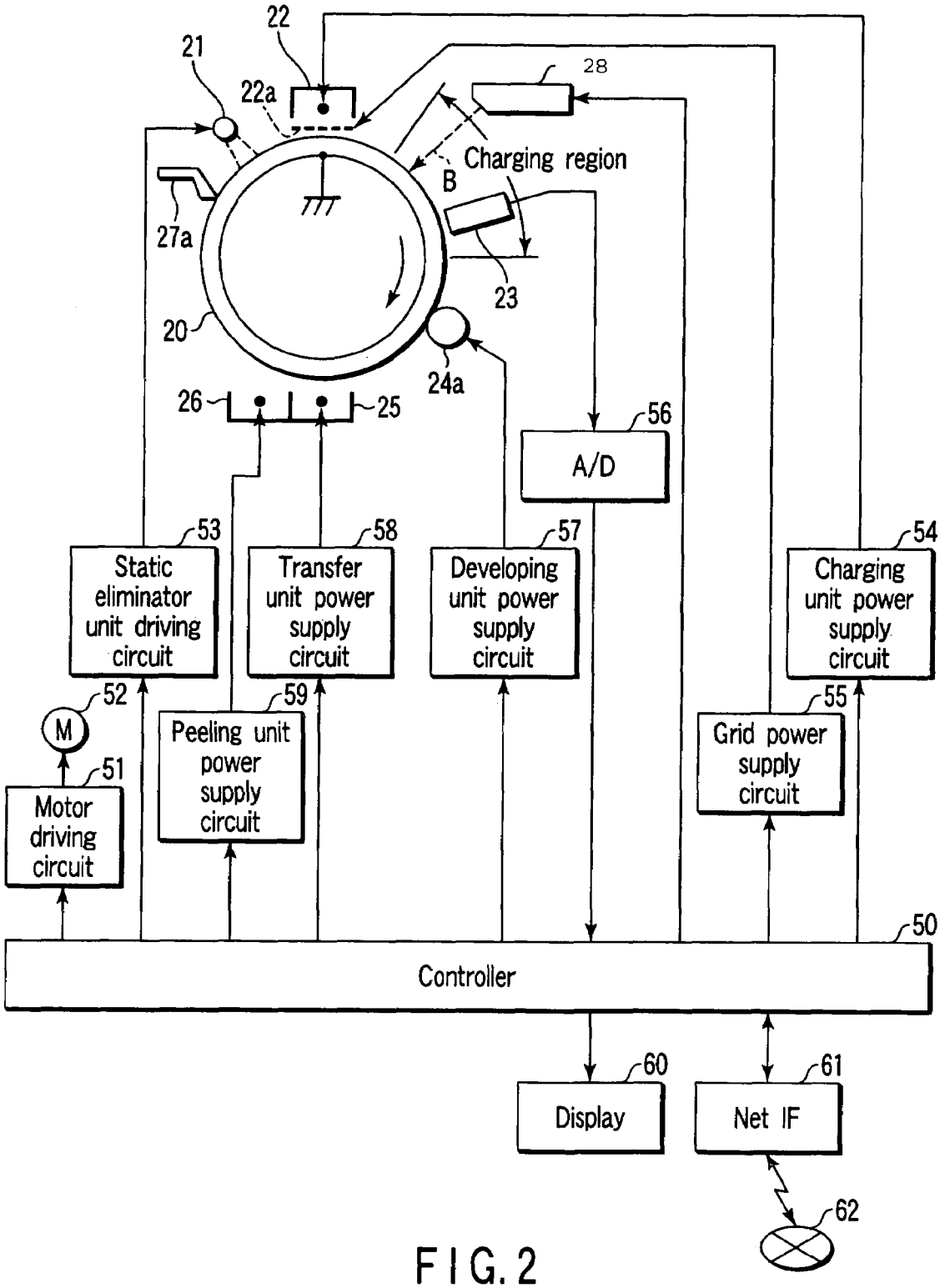
FIG. 2 is a diagram showing details of a part around a photosensitive drum, and a control circuit in each embodiment.

Details of a part around the photosensitive drum 20, and a control circuit are shown in FIG. 2.

Reference numeral 50 denotes a controller which controls the whole main body 1. The controller 50 is connected to a motor driving circuit 51, a static eliminator unit driving circuit 53, a charging unit driving circuit 54, a grid power supply circuit 55, an analog-to-digital (A/D) conversion unit 56, a developing unit power supply circuit 57, a transfer unit power supply circuit 58, a peeling unit power supply circuit 59, a display 60, and a net interface 61.

The motor driving circuit 51 drives a motor 52 in accordance with an instruction of the controller 50. The motor 52 drives the photosensitive drum 20, and also drives a conveying mechanism of the paper sheets P. The static eliminator unit driving circuit 53 drives the static eliminator unit 21 in accordance with the instruction of the controller 50. The charging unit driving circuit 54 outputs a high-level voltage for charging. The output is supplied to the charging unit 22. The grid power supply circuit 55 outputs a grid bias voltage for adjusting the charging output of the charging unit 22. The output is supplied to the grid 22*a* of the charging unit 22. The analog-to-digital (A/D) conversion unit 56 digitizes a detection signal of the potential sensor 23. The developing unit power supply circuit 57 outputs a bias voltage for the developing, so-called developing bias voltage to the developing unit 24. This developing bias voltage is supplied to the developing roller 24*a* of the developing unit 24. The transfer unit power supply circuit 58 outputs a high-level voltage for the transfer. The output is supplied to the transfer unit 25. The peeling unit power supply circuit 59 outputs a voltage for the peeling. The output is supplied to the peeling unit 26. The display 60 displays information to be notified to a user and a maintenance serviceman. The net interface 61 transmits/receives data between the controller 50 and an external apparatus via a communication network 62.

A function will be described.

Figure 3:
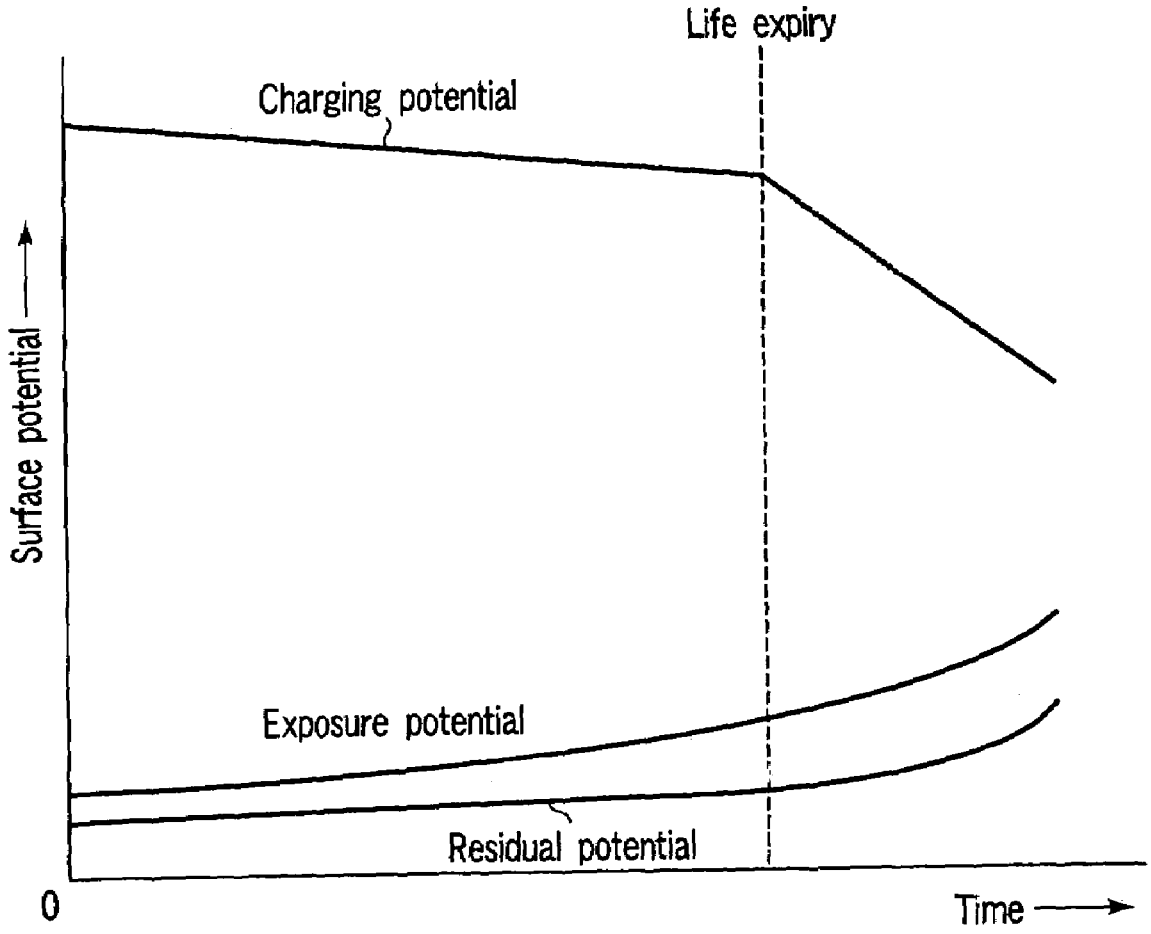
FIG. 3 is a diagram showing a change of a surface potential of the photosensitive drum in each embodiment.

FIG. 3 shows characteristic changes of a surface potential of the photosensitive drum 20. That is, a potential remaining on the surface of the photosensitive drum 20, to be eliminated by the static eliminator unit 21, so-called residual potential gradually drops as the use of the photosensitive drum 20 proceeds, and rapidly drops when the lifetime of the photosensitive drum 20 expires. The charging potential of the surface of the photosensitive drum 20 charged by the charging unit 22 gradually rises as the use of the photosensitive drum 20 proceeds. The exposure potential of the surface of the photosensitive drum 20 exposed by the exposure unit 28 also gradually rises as the use of the photosensitive drum 20 proceeds.

Figure 4:
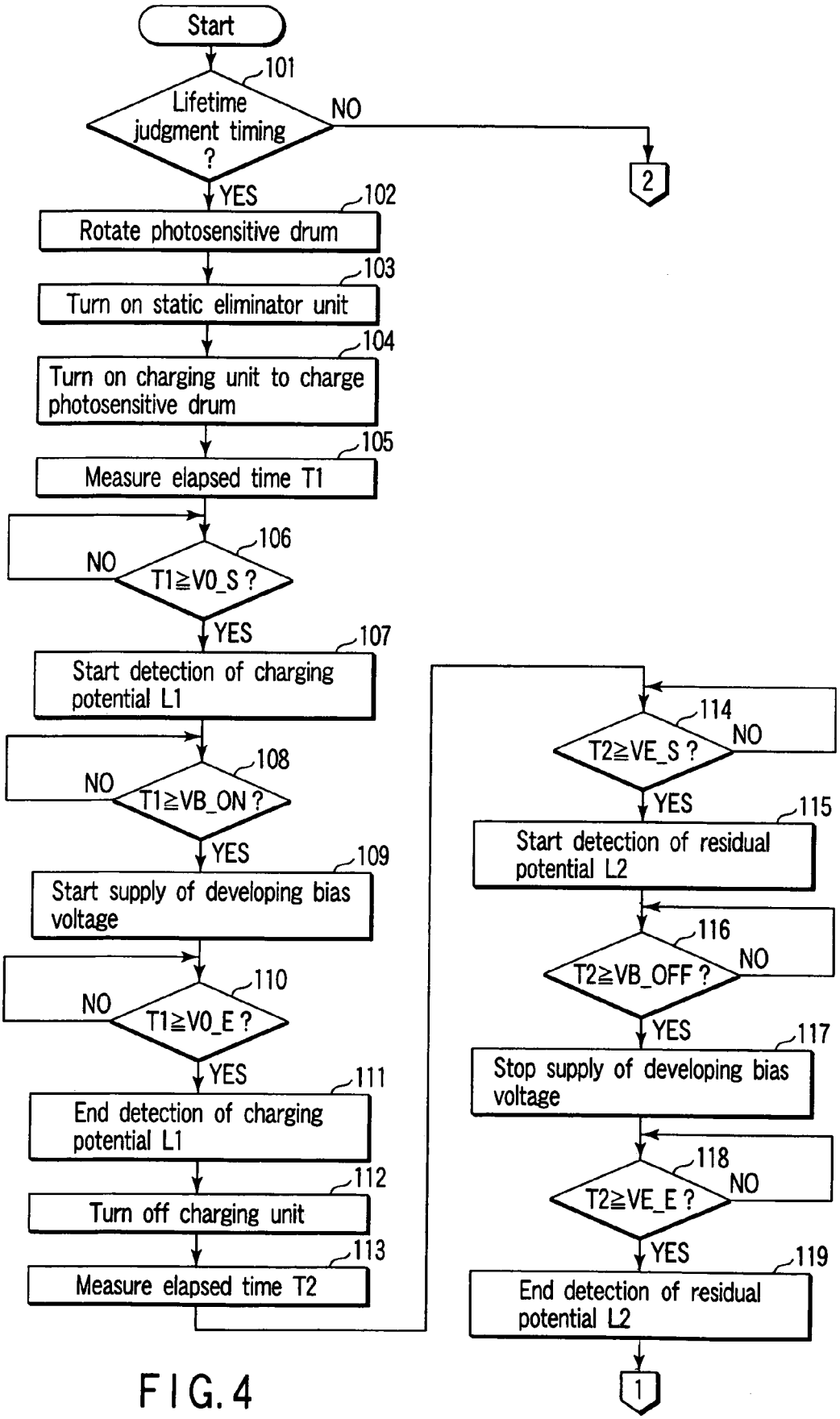
FIG. 4 is a flowchart showing a function of a first embodiment.
Figure 5:
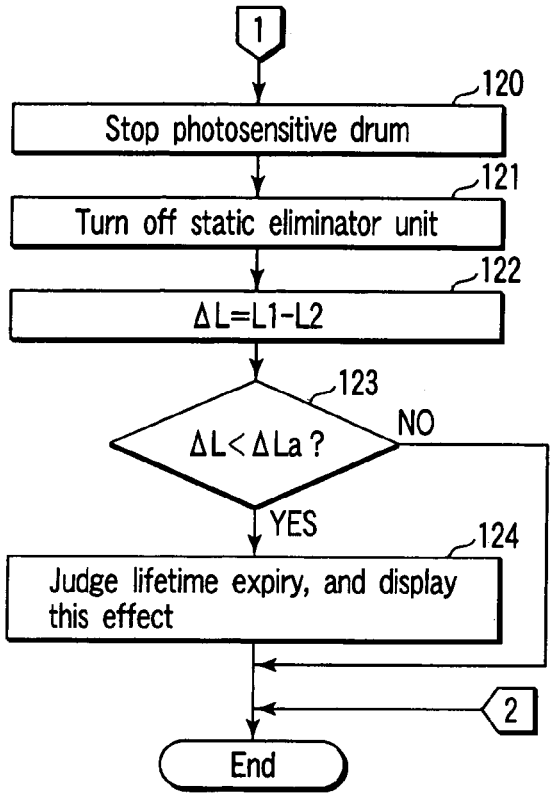
FIG. 5 is a flowchart subsequent to FIG. 4.

A lifetime judgment process of the controller 50 is shown in a flowchart of FIGS. 4 and 5.

In a periodic lifetime judgment timing (YES in step 101), rotation of the photosensitive drum 20 is started (step 102), and the static eliminator unit 21 is turned on (step 103). When the static eliminator unit 21 is turned on, the electric charge remaining on the surface of the photosensitive drum 20 is eliminated (static elimination). Moreover, the charging unit 22 is turned on. When the charging unit 22 is turned on, a predetermined region of the photosensitive drum 20 subjected to the static elimination is charged (step 104). To grasp a detection start timing (step 107) of a charging potential L1 in the charged region, a supply start timing (step 109) of the developing bias voltage, and a detection end timing (step 111) of the charging potential L1, respectively, an elapsed time T1 from when the charging unit 22 turns on is measured (step 105).

The elapsed time T1 from when the charging unit 22 turns on reaches a certain time VO_S or more (YES in step 106), and the charging potential L1 of the photosensitive drum 20 is detected by the potential sensor 23 (step 107).

The detection start timing of the charging potential L1 is determined based on the elapsed time T1 from when the charging unit 22 turns on in this manner, and accordingly the charging potential L1 of the charged region can be correctly detected.

The elapsed time T1 from when the charging unit 22 turns on reaches a certain time VB_ON (YES in step 108), and then the supply of the developing bias voltage with respect to the developing unit 24 is started (step 109). Unless the elapsed time T1 reaches the certain time VB_ON (NO in step 108), any developing bias voltage is not supplied to the developing unit 24.

Unless the elapsed time T1 reaches the certain time VB_ON, the region of the surface of the photosensitive drum 20 subjected to the static elimination corresponds to the position of the developing unit 24. In this term, no developing bias voltage is supplied to the developing unit 24. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T1 reaches the certain time VB_ON, the charged region of the surface of the photosensitive drum 20 corresponds to the position of the developing unit 24. At this time, the developing bias voltage is supplied to the developing unit 24. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

The elapsed time T1 from when the charging unit 22 turns on reaches the certain time VO_E or more (YES in step 110), and then the detection of the charging potential L1 by the potential sensor 23 is ended (step 111).

The detection end timing of the charging potential L1 is determined based on the elapsed time T1 from when the charging unit 22 turns on, and accordingly the detection of the charging potential L1 is securely completed.

When the detection of the charging potential L1 by the potential sensor 23 ends, the charging unit 22 is turned off (step 112). Moreover, to grasp a detection start timing (step 115) of a residual potential L2, a supply stop timing (step 117) of the developing bias voltage, and a detection end timing (step 119) of the residual potential L2, respectively, an elapsed time T2 from when the charging unit 22 turns off is measured (step 113).

The elapsed time T2 reaches a certain time VE_S or more (YES in step 114), and the residual potential L2 of the photosensitive drum 20 is detected by the potential sensor 23 (step 115).

The detection start timing of the residual potential L2 is determined based on the elapsed time T2 from when the charging unit 22 turns off in this manner, and accordingly the residual potential L2 of the static elimination region can be correctly detected.

The elapsed time T2 from when the charging unit 22 turns off reaches a certain time VB_OFF (YES in step 116), and then the supply of the developing bias voltage with respect to the developing unit 24 is stopped (step 117). Unless the elapsed time T2 reaches the certain time VB_OFF (NO in step 116), the supply of the developing bias voltage to the developing unit 24 is continued.

Unless the elapsed time T2 reaches the certain time VB_OFF, the charged region of the surface of the photosensitive drum 20 corresponds to the position of the developing unit 24. In this term, the supply of the developing bias voltage to the developing unit 24 is continued. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

When the elapsed time T2 reaches the certain time VB_OFF, the static elimination region of the surface of the photosensitive drum 20 corresponds to the position of the developing unit 24. At this time, the supply of the developing bias voltage is stopped. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T2 reaches the certain time VO_E or more (YES in step 118), the detection of the residual potential L2 by the potential sensor 23 is ended (step 119).

The detection end timing of the residual potential L2 is determined based on the elapsed time T2 from when the charging unit 22 turns off, and accordingly the detection of the residual potential L2 is securely completed.

When the detection of the residual potential L2 ends, the rotation of the photosensitive drum 20 is stopped (step 120), and the static eliminator unit 21 is turned off (step 121).

Moreover, a difference ΔL (=L1−L2) between the detected charging potential L1 and the detected residual potential L2 is calculated (step 122).

When the calculated potential difference ΔL is less than a predetermined set value ΔLa (YES in step 123), the lifetime expiry of the photosensitive drum 20 is judged, and this effect is displayed in the display 60 (step 124). By this display, the lifetime expiry of the photosensitive drum 20 is notified to the user. The user then asks a maintenance serviceman to change the photosensitive drum 20.

When the expired photosensitive drum 20 is replaced with a new one, the peripheral part of the photosensitive drum 20 can be prevented from being adversely affected. For example, a disadvantage that the developer (toner and carrier) sticks to the photosensitive drum 20 can be solved. The blade 27*a* of the cleaning unit 27 can be prevented from being broken.

When the calculated potential difference ΔL is the set value ΔLa or more (NO in step 123), nothing is displayed under judgment that the photosensitive drum 20 has not expired.

Figure 6:
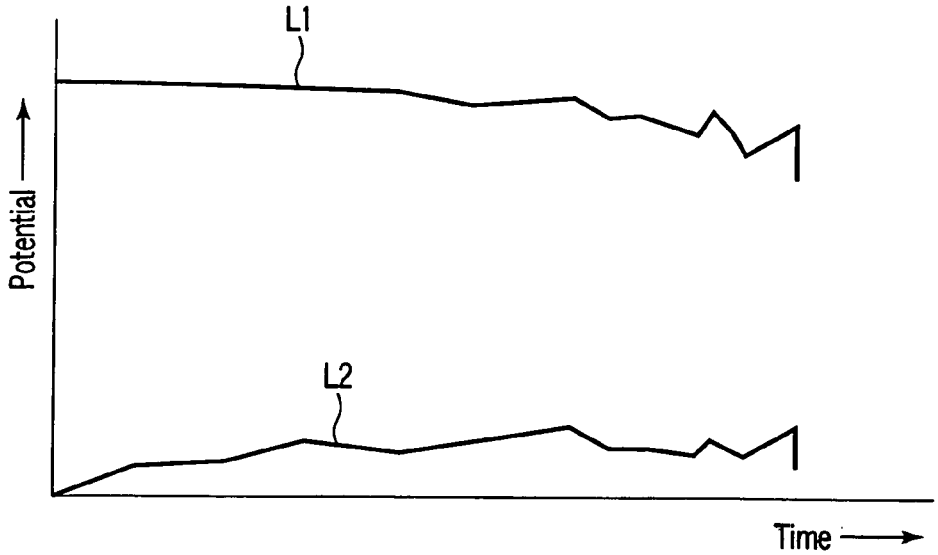
FIG. 6 is a diagram showing changes of a charging potential and a residual potential in the first embodiment.

FIG. 6 shows an example of changes of the charging potential L1 and the residual potential L2.

Figure 7:
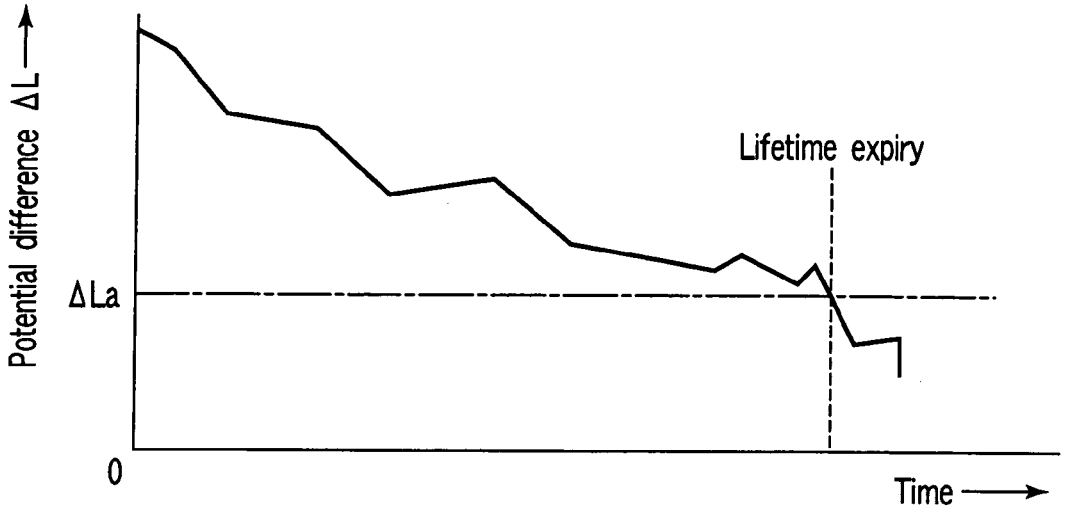
FIG. 7 is a diagram showing a change of a difference between the charging potential and the residual potential in the first embodiment.

FIG. 7 shows a state of a change of the potential difference ΔL.

The residual potential L1 is influenced by the residual potential L2, and fluctuates. Therefore, it is difficult to correctly judge the lifetime of the photosensitive drum 20 only by the charging potential L1. Therefore, to cancel the fluctuation of the residual potential L2 which influences the charging potential L1, the residual potential L2 is subtracted from the charging potential L1, and the subtraction result ΔL (=L1−L2) is used in judging the lifetime of the photosensitive drum 20. Therefore, the lifetime of the photosensitive drum 20 can be quickly and precisely judged.

Additionally, the certain time VO_S for determining the detection start timing of the charging potential L1, the certain time VB_ON for determining the supply start timing of the developing bias voltage, the certain time VO_E for determining the detection end timing of the charging potential L1, the certain time VE_S for determining the detection start timing of the residual potential L2, the certain time VB_OFF for determining the supply start timing of the developing bias voltage, and the certain time VE_E for determining the detection end timing of the residual potential L2 are set as follows.

Figure 8:
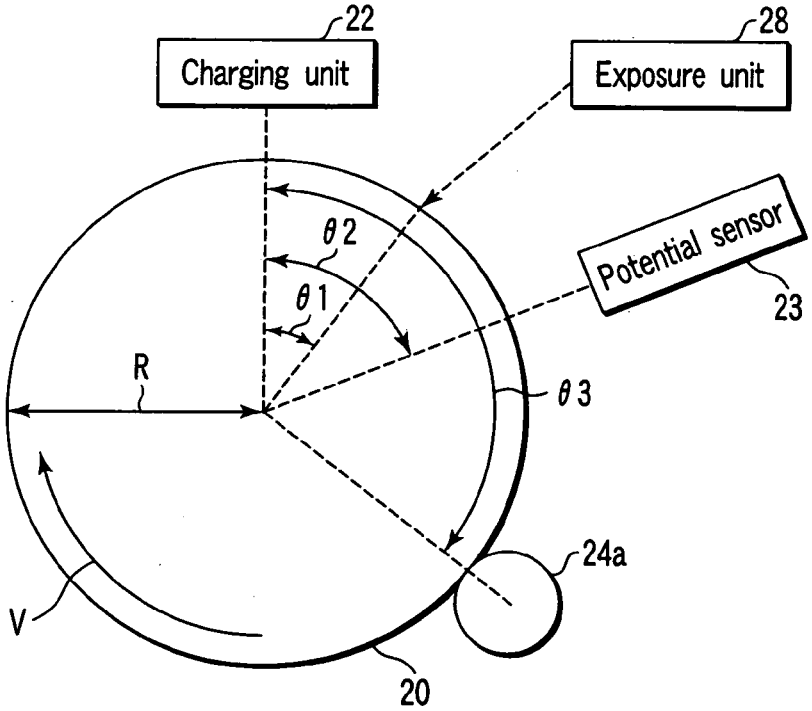
FIG. 8 is an explanatory view showing a method of obtaining each certain time in each embodiment.

As shown in FIG. 8, it is assumed that a radius of the photosensitive drum 20 is R [mm], a rotation speed of the photosensitive drum 20 is V [mm/s], an angle between the charging position of the charging unit 22 and the exposure position of the exposure unit 28 is θ1, an angle between the charging position of the charging unit 22 and the detection position of the potential sensor 23 is θ2, an angle between the charging position of the charging unit 22 and the developing position of the developing roller 24*a* is θ3, and the ratio of the circumference of a circle to its diameter is π.

The certain time VO_S for determining the detection start timing of the charging potential L1 is obtained by the following equation (1) in a case where a time required from when the controller 50 outputs a charging start signal until the output of the charging unit 22 is actually started is ΔVG_ON, and a detection response time of the potential sensor 23 is ΔVO_S:

$$\mathrm{VO_S} = 2 \times \pi \times R \times (\theta 2 \div 360) \div V + \Delta \mathrm{VG_ON} + \Delta \mathrm{VO_S}. \quad (1)$$

The certain time VB_ON for determining the supply start timing of the developing bias voltage is obtained by the following equation (2) in a case where a time required from when the controller 50 outputs the charging start signal until the output of the charging unit 22 is actually started is ΔVG_ON, and a time required from when the controller 50 outputs a supply start signal of the developing bias voltage until the developing bias voltage is actually supplied to the developing unit 24 is ΔVB_ON:

$$\mathrm{VB_ON} = 2 \times \pi \times R \times (\theta 3 \div 360) \div V + \Delta \mathrm{VG_ON} + \Delta \mathrm{VB_ON}. \quad (2)$$

The certain time VO_E for determining the detection end timing of the charging potential L1 is obtained by the following equation (3) in a case where a time required from when the controller 50 outputs the charging start signal until the output of the charging unit 22 is actually started is ΔVG_ON, the detection response time of the potential sensor 23 is ΔVO_S, and a time required from the start of the detection of the charging potential L1 by the potential sensor 23 until the end of the detection is ΔVO_E:

$$\begin{aligned} \text{VO_E} &= \begin{matrix} 2\times\pi\times R\times(\theta 2\div 360)\div V + \\ \Delta\text{VG_ON}+\Delta\text{VO_S}+\Delta\text{VO_E} \end{matrix} \\ &= \text{VO_S}+\Delta\text{VO_E} \end{aligned} \quad (3)$$

The certain time VE_S for determining the detection start timing of the residual potential L2 is obtained by the following equation (4) in a case where a time required from when the controller 50 outputs a charging stop signal until the output of the charging unit 22 is actually stopped is ΔVG_OFF, and the detection response time of the potential sensor 23 is ΔVE_S:

$$\text{VE_S} = 2\times\pi\times R\times(\theta 02\div 360)\div V + \Delta\text{VG_OFF}+\Delta\text{VE_S}. \quad (4)$$

The certain time VB_OFF for determining the supply start timing of the developing bias voltage is obtained by the following equation (5) in a case where a time required from when the controller 50 outputs the charging stop signal until the output of the charging unit 22 is actually stopped is ΔVG_OFF, and a time required from when the controller 50 outputs a supply stop signal of the developing bias voltage until the supply of the developing bias voltage is actually stopped is ΔVB_OFF:

$$\text{VB_OFF} = 2\times\pi\times R\times(\theta 3\div 360)\div V + \Delta\text{VG_OFF}+\Delta\text{VB_OFF}. \quad (5)$$

The certain time VE_E for determining the detection end timing of the residual potential L2 is obtained by the following equation (6) in a case where a time required from when the controller 50 outputs the charging stop signal until the output of the charging unit 22 is actually stopped is ΔVG_OFF, the detection response time of the potential sensor 23 is ΔVE_S, and a time required from the start of the detection of the residual potential L2 by the potential sensor 23 until the end of the detection is ΔVE_E:

$$\begin{aligned} \text{VE_E} &= \begin{matrix} 2\times\pi\times R\times(\theta 2\div 360)\div V + \\ \Delta\text{VG_OFF}+\Delta\text{VE_S}+\Delta\text{VE_E} \end{matrix} \\ &= \text{VE_S}+\Delta\text{VE_E} \end{aligned} \quad (6)$$

[2] A second embodiment of the present invention will be described.

The constitution is the same as that of the first embodiment.

Figure 9:
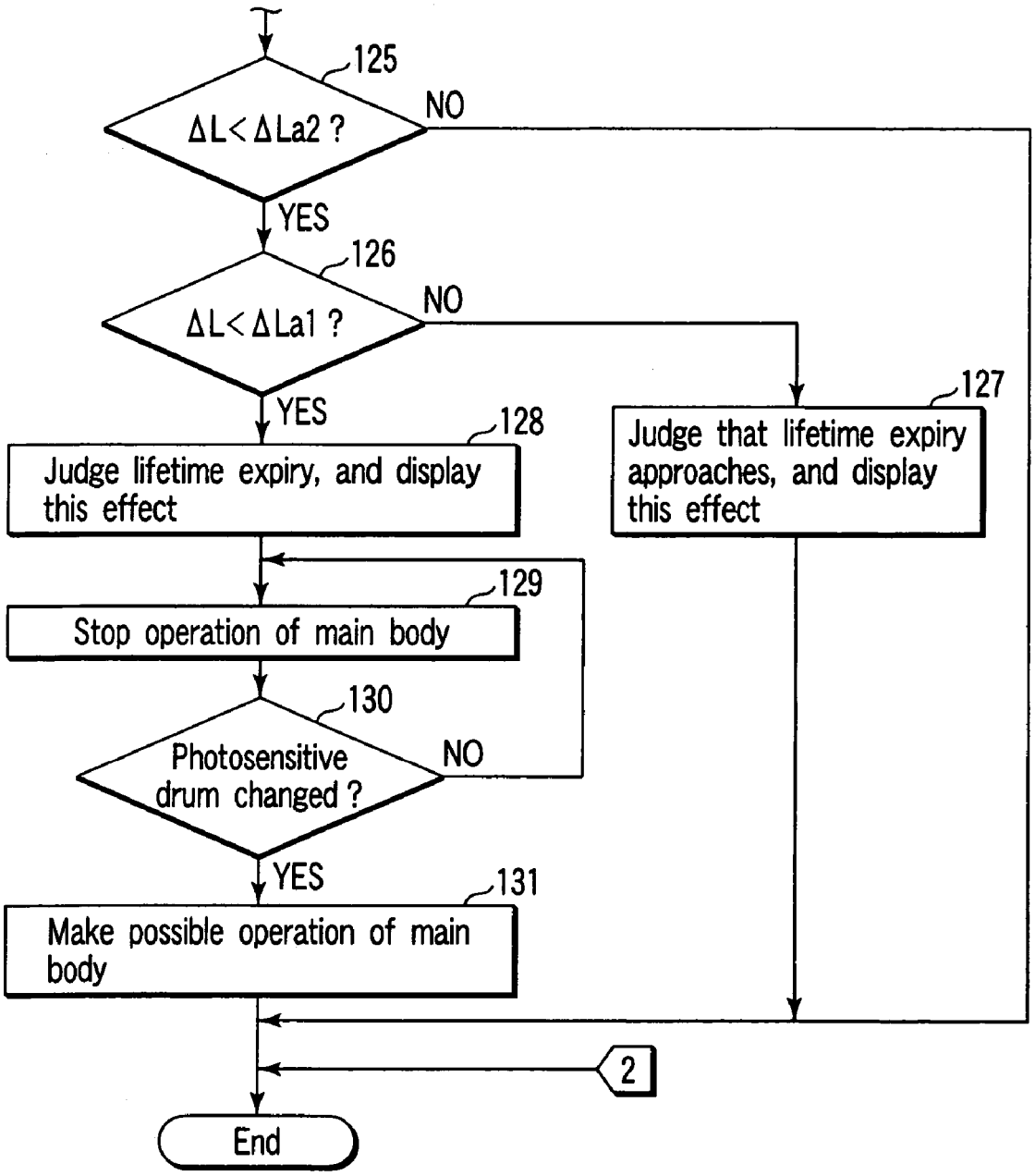
FIG. 9 is a flowchart showing a main part of a function of a second embodiment.

Instead of the process of steps 123 and 124 of the first embodiment, a process of steps 125 to 131 shown in a flowchart of FIG. 9 is executed. Since other processes are the same as those of the first embodiment, the description is omitted.

That is, when a calculated potential difference ΔL is not less than a predetermined set value ΔLa2 (NO in step 125), nothing is displayed judging that the photosensitive drum 20 has not expired.

When the potential difference ΔL is less than the set value ΔLa2 (YES in step 125), the potential difference ΔL is compared with a predetermined set value ΔLa1 (<ΔLa2) (step 126). When the potential difference ΔL is not less than the set value ΔLa1 (NO in step 126), it is judged that the photosensitive drum 20 has nearly expired, and the effect is displayed in the display 60 (step 127). By this display, it is notified to the user that the photosensitive drum 20 has nearly expired.

The user can recognize in advance that the photosensitive drum 20 approaches a change time. Accordingly, the user can ask a maintenance serviceman to change the photosensitive drum 20 at a convenient timing.

When the potential difference ΔL is less than the set value ΔLa1 (YES in step 126), it is judged that the photosensitive drum 20 has lifetime expiry, and this effect is displayed in the display 60 (step 128). Moreover, the operation of a main body 1 is stopped (step 129). Unless the photosensitive drum 20 is changed (NO in step 130), an operation stop state of the main body 1 is continued.

When the photosensitive drum 20 is changed (YES in step 130), the operation of the main body 1 is possible (step 131).

[3] A third embodiment of the present invention will be described.

A constitution is the same as that of the first embodiment.

Figure 10:
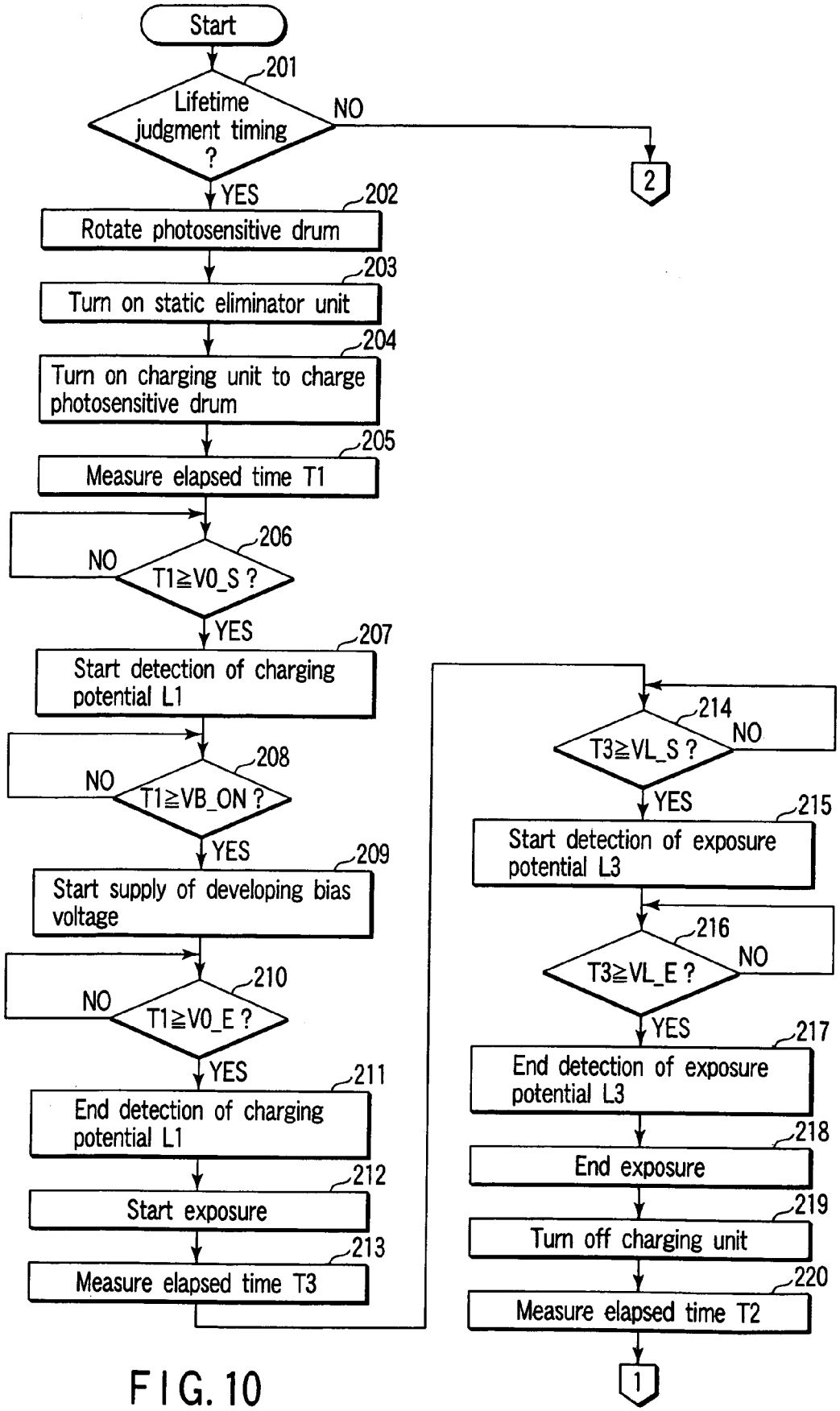
FIG. 10 is a flowchart showing a function of a third embodiment.
Figure 11:
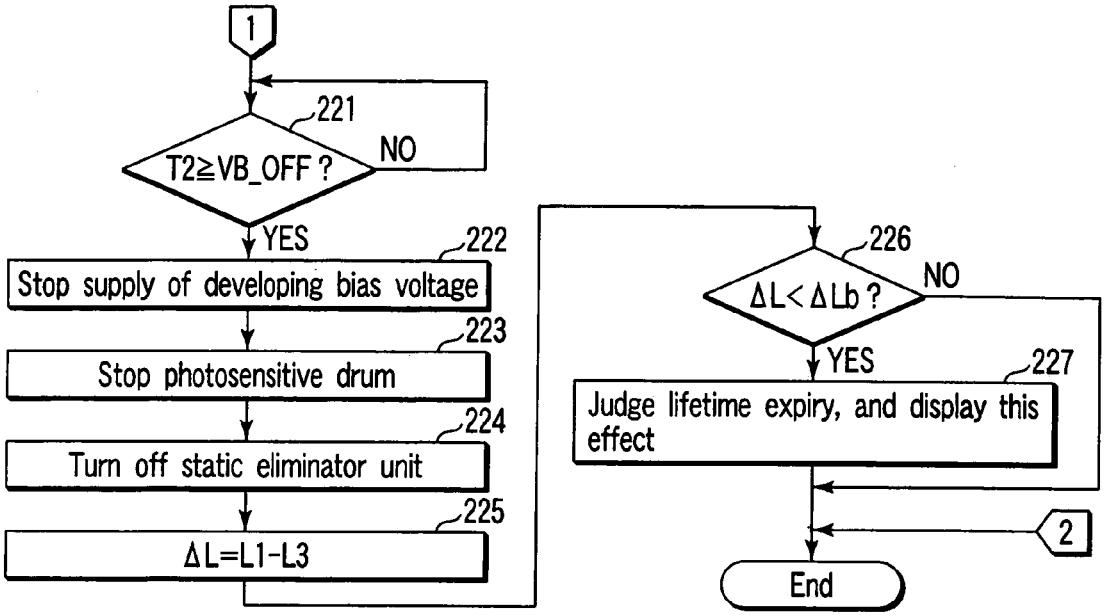
FIG. 11 is a flowchart subsequent to FIG. 10.

A function will be described. A lifetime judgment process of a controller 50 is shown in a flowchart of FIGS. 10 and 11.

In a periodic lifetime detection timing (YES in step 201), rotation of a photosensitive drum 20 is started (step 202), and a static eliminator unit 21 is turned on (step 203).

When the static eliminator unit 21 is turned on, an electric charge remaining on a surface potential of the photosensitive drum 20 is eliminated (static elimination). A predetermined region of the surface of the photosensitive drum 20 subjected to the static elimination is charged by a charging unit 22 (step 204). Moreover, to grasp a detection start timing (step 207) of a charging potential L1, a supply start timing (step 209) of a developing bias voltage, and a detection end timing (step 211) of the charging potential L1, respectively, an elapsed time T1 from when the charging unit 22 turns on is measured (step 205).

The elapsed time T1 from when the charging unit 22 turns on reaches a certain time VO_S or more (YES in step 206), and the detection of the charging potential L1 of the photosensitive drum 20 is started by the potential sensor 23 (step 207).

The detection start timing of the charging potential L1 is determined based on the elapsed time T1 from when the charging unit 22 turns on in this manner, and accordingly the charging potential L1 of a charged region can be correctly detected.

The elapsed time T1 from when the charging unit 22 turns on reaches a certain time VB_ON (YES in step 208), and then the supply of the developing bias voltage with respect to a developing unit 24 is started (step 209). Unless the elapsed time T1 reaches the certain time VB_ON (NO in step 208), no developing bias voltage is supplied to the developing unit 24.

Unless the elapsed time T1 reaches the certain time VB_ON, the static elimination region of the surface of the photosensitive drum 20 corresponds to the position of the developing unit 24. In this term, no developing bias voltage is supplied to the developing unit 24. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T1 reaches the certain time VB_ON, the charged region of the surface of the photosensitive drum 20 corresponds to the position of the developing unit 24. At this time, the supply of the developing bias voltage to the developing unit 24 is started. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

The elapsed time T1 from when the charging unit 22 turns on reaches the certain time VO_E or more (YES in step 210), and then the detection of the charging potential L1 by the potential sensor 23 is ended (step 211).

The detection end timing of the charging potential L1 is determined based on the elapsed time T1 from when the charging unit 22 turns on, and accordingly the detection of the charging potential L1 is securely completed.

When an exposure start signal LD_ON is supplied to an exposure unit 28 from the controller 50, the charged region of the surface of the photosensitive drum 20 is exposed (step 212). Moreover, to grasp a detection start timing (step 215) of an exposure potential L3 in this exposure region, and a detection end timing (step 217) of the exposure potential L3, respectively, an elapsed time T3 from the start of the exposure is measured (step 213).

When the detection start timing and the detection end timing of the exposure potential L3 are managed based on the elapsed time T3 from the start of the exposure, the time required for the detection of the exposure potential L3 can be minimized. Accordingly, the size of the exposure region can be reduced in such a manner as to be as small as possible. Since the size of the exposure region can be reduced as much as possible, the amount of developer attracted to the exposure region can be reduced. Therefore, the developer can be inhibited from being wasted.

When the elapsed time T3 from the exposure start reaches a certain time VL_S or more (YES in step 214), the detection of the exposure potential L3 in the exposure region of the photosensitive drum 20 is started (step 215).

When the elapsed time T3 reaches a certain time VL_E or more (YES in step 216), the detection of the exposure potential L3 is ended (step 217). Moreover, an exposure end signal LD_OFF is supplied to the exposure unit 28 from the controller 50, and the exposure by the exposure unit 28 ends (step 218). Furthermore, the charging unit 22 is turned off (step 219).

Moreover, to grasp a supply stop timing (step 222) of the developing bias voltage, an elapsed time T2 from when the charging unit 22 turns off is measured (step 220).

The elapsed time T2 from when the charging unit 22 turns off reaches a certain time VB_OFF (YES in step 221), and then the supply of the developing bias voltage with respect to the developing unit 24 is stopped (step 222). Unless the elapsed time T2 reaches the certain time VB_OFF (NO in step 221), the supply of the developing bias voltage to the developing unit 24 is continued.

Unless the elapsed time T2 reaches the certain time VB_OFF, the charged region of the surface of the photosensitive drum 20 corresponds to the position of the developing unit 24. In this term, the supply of the developing bias voltage to the developing unit 24 is continued. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

When the elapsed time T2 reaches the certain time VB_OFF, the static elimination region of the surface of the photosensitive drum 20 corresponds to the position of the developing unit 24. At this time, the supply of the developing bias voltage to the developing unit 24 is stopped. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

After the supply of the developing bias voltage to the developing unit 24 is stopped, the rotation of the photosensitive drum 20 is stopped (step 223), and the static eliminator unit 21 is turned off (step 224).

Moreover, a difference ΔL (=L1−L3) between the detected charging potential L1 and the detected exposure potential L3 is calculated (step 225).

When the calculated potential difference ΔL is less than a predetermined set value ΔLb (YES in step 226), it is judged that the lifetime of the photosensitive drum 20 has expired, and this effect is displayed in the display 60 (step 227). By this display, the lifetime expiry of the photosensitive drum 20 is notified to the user. The user then asks a maintenance serviceman to change the photosensitive drum 20.

When the calculated potential difference ΔL is the set value ΔLb or more (NO in step 226), nothing is displayed judging that the lifetime of the photosensitive drum 20 has not expired.

Additionally, a certain time VL_S for determining the detection start timing of the exposure potential L3, and a certain time VL_E for determining the detection end timing of the exposure potential L3 are set as follows.

As shown in FIG. 8, it is assumed that a radius of the photosensitive drum 20 is R [mm], a rotation speed of the photosensitive drum 20 is V [mm/s], an angle between the charging position of the charging unit 22 and the exposure position of the exposure unit 28 is θ1, an angle between the charging position of the charging unit 22 and the detection position of the potential sensor 23 is θ2, an angle between the charging position of the charging unit 22 and the developing position of the developing roller 24*a* is θ3, and the ratio of the circumference of a circle to its diameter is π.

The certain time VL_S for determining the detection start timing of the charging potential L3 is obtained by the following equation (7) in a case where a time required from when the controller 50 outputs the exposure start signal LD_ON until the photosensitive drum 20 is actually exposed is ΔVL_ON, and a detection response time of the potential sensor 23 is ΔVL_S:

$$\mathrm{VL_S} = 2 \times \pi \times R \times [(\theta 2 - \theta 1) \div 360]] \div V + \Delta \mathrm{VL_ON} + \Delta \mathrm{VL_S}. \quad (7)$$

The certain time VL_E for determining the detection end timing of the exposure potential L3 is obtained by the following equation (8) in a case where a time required from the start of the detection of the exposure potential L3 by the potential sensor 23 until the end of the detection is ΔVL_E, and a time required from when the controller 50 outputs the exposure end signal LD_OFF until the exposure of the photosensitive drum 20 is stopped is ΔVL_OFF:

$$\begin{aligned} VL_S &= 2\times\pi\times R\times[(\theta 2-\theta 1)\div 360]\div\Delta VL_ON+\Delta VL_S+\Delta VL_E+\Delta VL_OFF \\ &= VL_S+\Delta VL_E+\Delta VL_OFF \end{aligned} \quad (8)$$

Since methods for obtaining other certain times have been described in the first embodiment, the description is omitted.

[4] A fourth embodiment of the present invention will be described.

The constitution is the same as that of the first embodiment.

Figure 12:
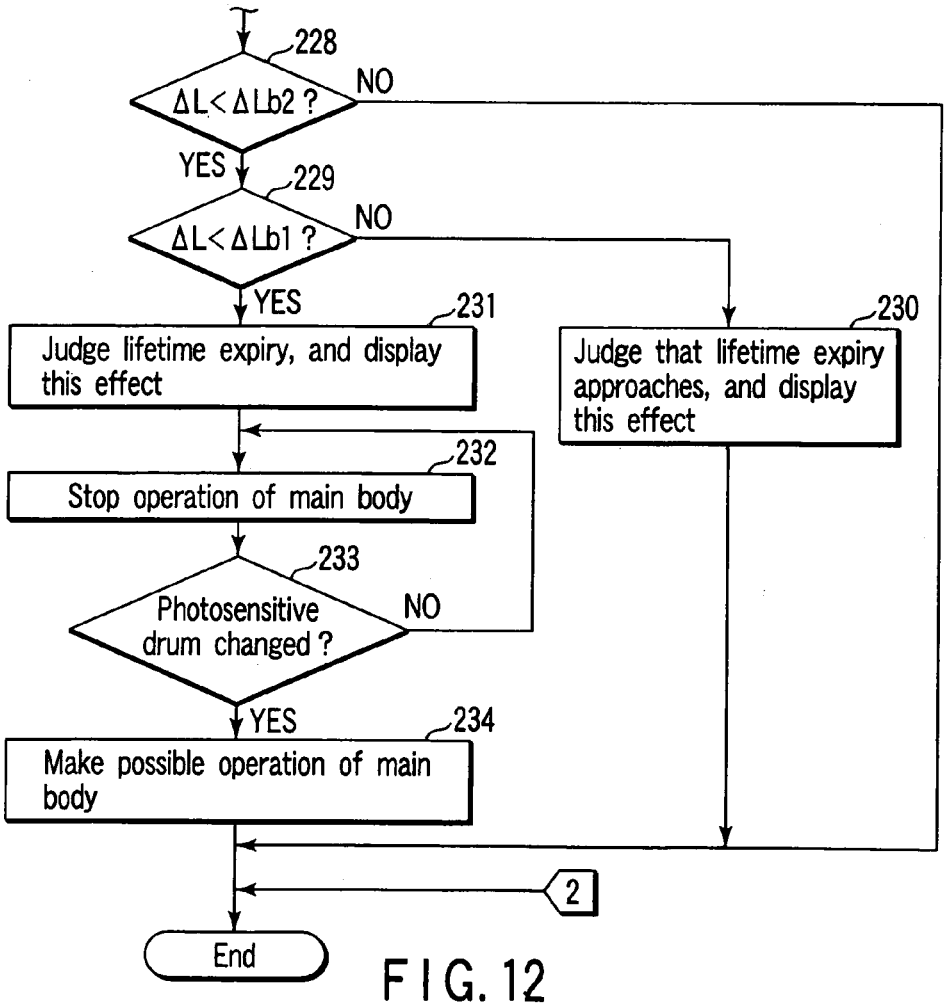
FIG. 12 is a flowchart showing a main part of a function of a fourth embodiment.

Instead of the process of steps 226 and 227 of the third embodiment, a process of steps 228 to 234 shown in a flowchart of FIG. 12 is executed. Since other processes are the same as those of the third embodiment, the description is omitted.

That is, when a calculated potential difference ΔL is not less than a predetermined set value ΔLb2 (NO in step 228), nothing is displayed judging that the photosensitive drum 20 has not expired.

When the potential difference ΔL is less than the set value ΔLb2 (YES in step 228), the potential difference ΔL is compared with a predetermined set value ΔLb1 (<ΔLb2) (step 229). When the potential difference ΔL is not less than the set value ΔLb1 (NO in step 229), it is judged that the photosensitive drum 20 has nearly expired, and this effect is displayed in the display 60 (step 230). By this display, it is notified to the user that the photosensitive drum 20 has nearly expired.

The user can recognize in advance that the photosensitive drum 20 approaches a change time. Accordingly, the user can ask a maintenance serviceman to change the photosensitive drum 20 at a convenient timing.

When the potential difference ΔL is less than the set value ΔLb1 (YES in step 229), it is judged that the photosensitive drum 20 has lifetime expiry, and this effect is displayed in the display 60 (step 231). Moreover, the operation of a main body 1 is stopped (step 232). Unless the photosensitive drum 20 is changed (NO in step 233), an operation stop state of the main body 1 is continued.

When the photosensitive drum 20 is changed (YES in step 233), the operation of the main body 1 is possible (step 234).

[5] A fifth embodiment of the present invention will be described.

A constitution is the same as that of the first embodiment.

Figure 13:
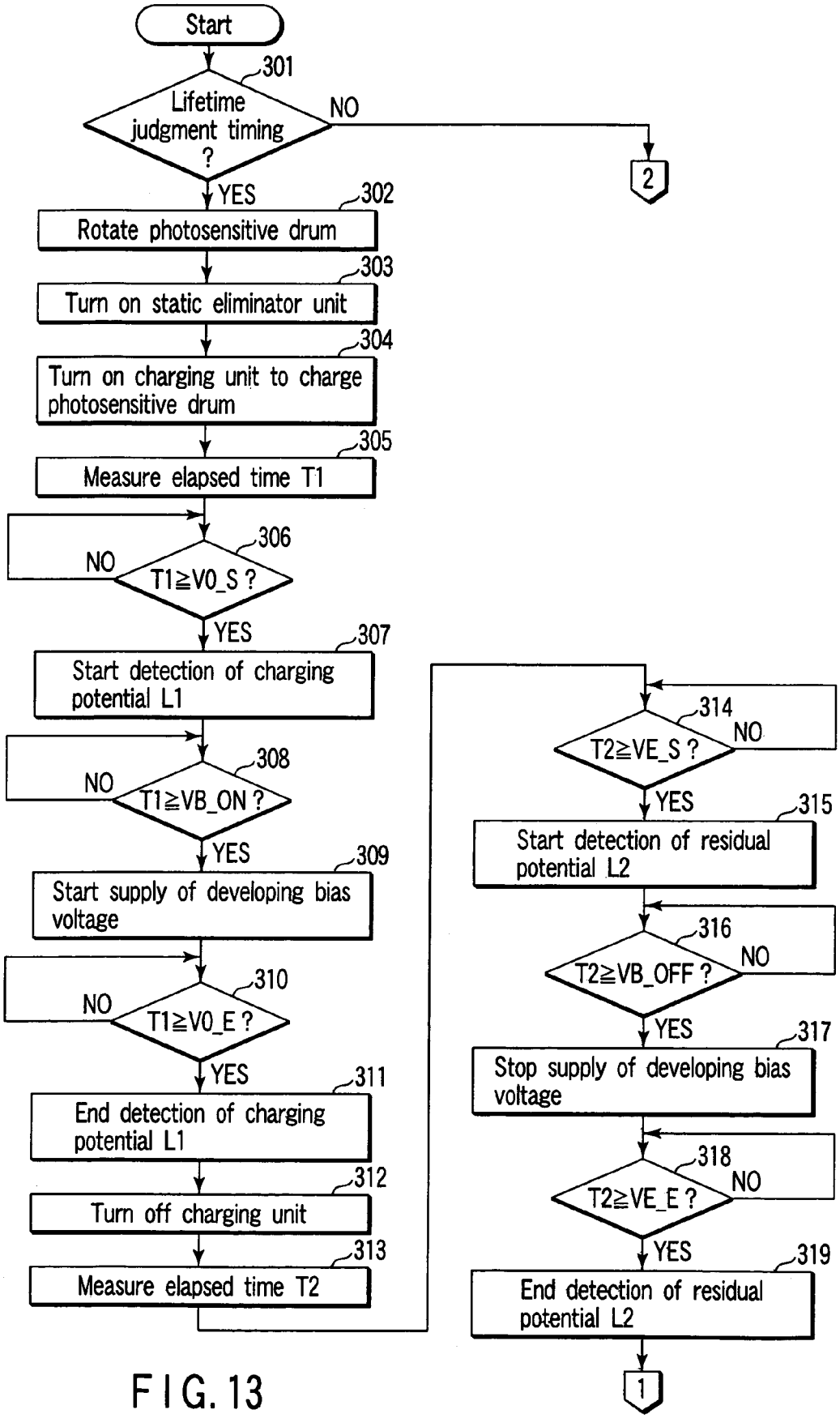
FIG. 13 is a flowchart showing a function of a fifth embodiment.
Figure 14:
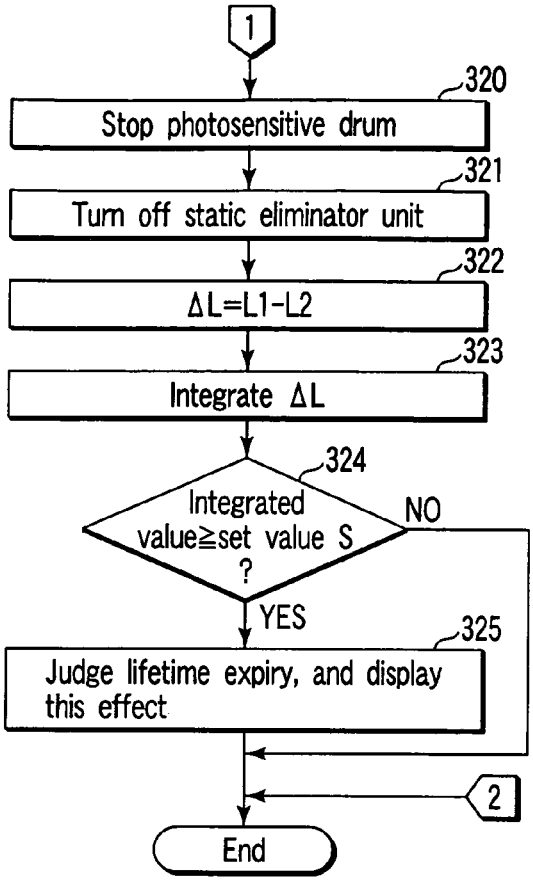
FIG. 14 is a flowchart subsequent to FIG. 13.

A function will be described. A lifetime judgment process of a controller 50 is shown in a flowchart of FIGS. 13 and 14.

In a periodic lifetime judgment timing (YES in step 301), rotation of a photosensitive drum 20 is started (step 302), and a static eliminator unit 21 is turned on (step 303).

When the static eliminator unit 21 is turned on, electric charges remaining on the surface of the photosensitive drum 20 are eliminated (static elimination). Moreover, a charging unit 22 is turned on. When the charging unit 22 is turned on, a predetermined region of the surface of the photosensitive drum 20 subjected to the static elimination is charged (step 304). To grasp a detection start timing (step 307) of a charging potential L1 in the charged region, a supply start timing (step 309) of a developing bias voltage, and a detection end timing (step 311) of the charging potential L1, respectively, an elapsed time T1 from when the charging unit 22 turns on is measured (step 305).

The elapsed time T1 from when the charging unit 22 turns on reaches a certain time VO_S or more (YES in step 306), and the charging potential L1 of the photosensitive drum 20 is detected by a potential sensor 23 (step 307).

The detection start timing of the charging potential L1 is determined based on the elapsed time T1 from when the charging unit 22 turns on in this manner, and accordingly the charging potential L1 can be correctly detected.

The elapsed time T1 from when the charging unit 22 turns on reaches a certain time VB_ON (YES in step 308), and then the supply of the developing bias voltage with respect to a developing unit 24 is started (step 309). Unless the elapsed time T1 reaches the certain time VB_ON (NO in step 308), no developing bias voltage is supplied to the developing unit 24.

Unless the elapsed time T1 reaches the certain time VB_ON, the static elimination region of the surface of the photosensitive drum 20 corresponds to the position of the developing unit 24. In this term, no developing bias voltage is supplied to the developing unit 24. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T1 reaches the certain time VB_ON, the charged region of the surface of the photosensitive drum 20 corresponds to the position of the developing unit 24. At this time, the supply of the developing bias voltage to the developing unit 24 is started. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

The elapsed time T1 from when the charging unit 22 turns on reaches the certain time VO_E or more (YES in step 310), and then the detection of the charging potential L1 of the potential sensor 23 is ended (step 311).

The detection end timing of the charging potential L1 is determined based on the elapsed time T1 from when the charging unit 22 turns on, and accordingly the detection of the charging potential L1 is securely completed.

When the detection of the charging potential L1 by the potential sensor 23 ends, the charging unit 22 is turned off (step 312). Moreover, to grasp a detection start timing (step 315) of a residual potential L2, a supply stop timing (step 317) of the developing bias voltage, and a detection end timing (step 319) of the residual potential L2, respectively, an elapsed time T2 from when the charging unit 22 turns off is measured (step 313).

When the elapsed time T2 reaches a certain time VE_S or more (YES in step 314), the residual potential L2 of the photosensitive drum 20 is detected by the potential sensor 23 (step 315).

The detection start timing of the residual potential L2 is determined based on the elapsed time T2 from when the charging unit 22 turns off in this manner, and accordingly the residual potential L2 of the static elimination region can be correctly detected.

The elapsed time T2 from when the charging unit 22 turns off reaches a certain time VB_OFF (YES in step 316), and then the supply of the developing bias voltage with respect to the developing unit 24 is stopped (step 317). Unless the elapsed time T2 reaches the certain time VB_OFF (NO in step 316), the supply of the developing bias voltage to the developing unit 24 is continued.

Unless the elapsed time T2 reaches the certain time VB_OFF, the charged region of the surface of the photosensitive drum 20 corresponds to the position of the developing unit 24. In this term, the supply of the developing bias voltage to the developing unit 24 is continued. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

When the elapsed time T2 reaches the certain time VB_OFF, the static elimination region of the surface of the photosensitive drum 20 corresponds to the position of the developing unit 24. At this time, the supply of the developing bias voltage to the developing unit 24 is stopped. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T2 reaches the certain time VE_E or more (YES in step 318), the detection of the residual potential L2 by the potential sensor 23 is ended (step 319).

The detection end timing of the residual potential L2 is determined based on the elapsed time T2 from when the charging unit 22 turns off, and accordingly the detection of the residual potential L2 is securely completed.

When the detection of the residual potential L2 ends, the rotation of the photosensitive drum 20 is stopped (step 320), and the static eliminator unit 21 is turned off (step 321).

Moreover, a difference ΔL (=L1−L2) between the detected charging potential L1 and the detected residual potential L2 is calculated (step 322).

The calculated potential difference ΔL is integrated (step 323), and an integrated value is compared with a predetermined set value S (step 324). When the integrated value is not less than the set value S (step 324), it is judged that the photosensitive drum 20 has lifetime expiry, and this effect is displayed in a display 60 (step 325). By this display, the lifetime expiry of the photosensitive drum 20 is notified to the user. The user then asks a maintenance serviceman to change the photosensitive drum 20.

When the integrated value is less than the set value S (NO in step 324), nothing is displayed judging that the lifetime of the photosensitive drum 20 has not expired.

Figure 15:
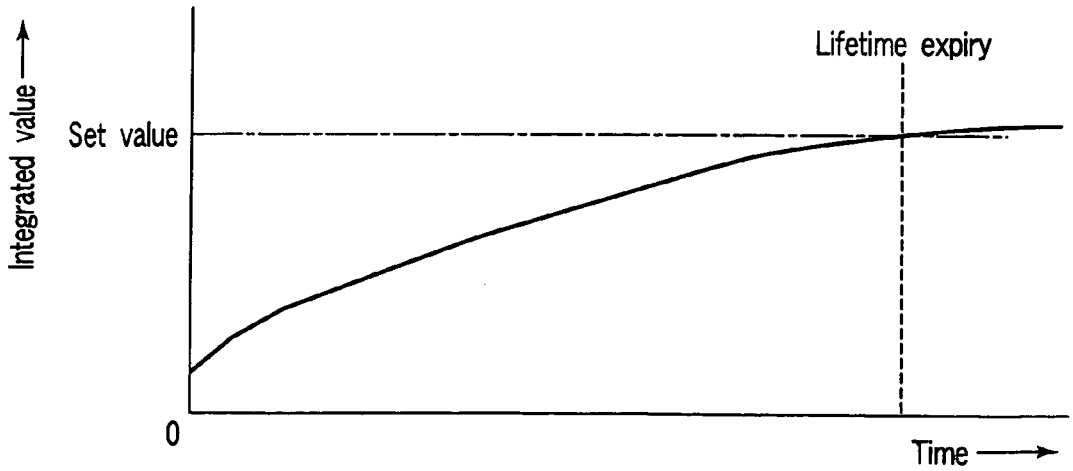
FIG. 15 is a diagram showing a change of an integrated value in the fifth embodiment.

FIG. 15 shows a relation between a change of the integrated value and the set value.

The charging potential L1 is influenced by the residual potential L2, and fluctuates. Therefore, it is difficult to exactly judge the lifetime of the photosensitive drum 20 only by the charging potential L1. Therefore, to cancel the fluctuation of the residual potential L2 which influences the charging potential L1, the residual potential L2 is subtracted from the charging potential L1, and the integrated value of a subtraction result ΔL (=L1−L2) is used in judging the lifetime of the photosensitive drum 20. The integrated value of the subtraction result ΔL is a value constantly changing in a rising direction, and is easily compared with the set value which is a judgment standard of the lifetime expiry. Therefore, the lifetime of the photosensitive drum 20 can be quickly and correctly judged.

[6] A sixth embodiment of the present invention will be described.

The constitution is the same as that of the first embodiment.

Figure 16:
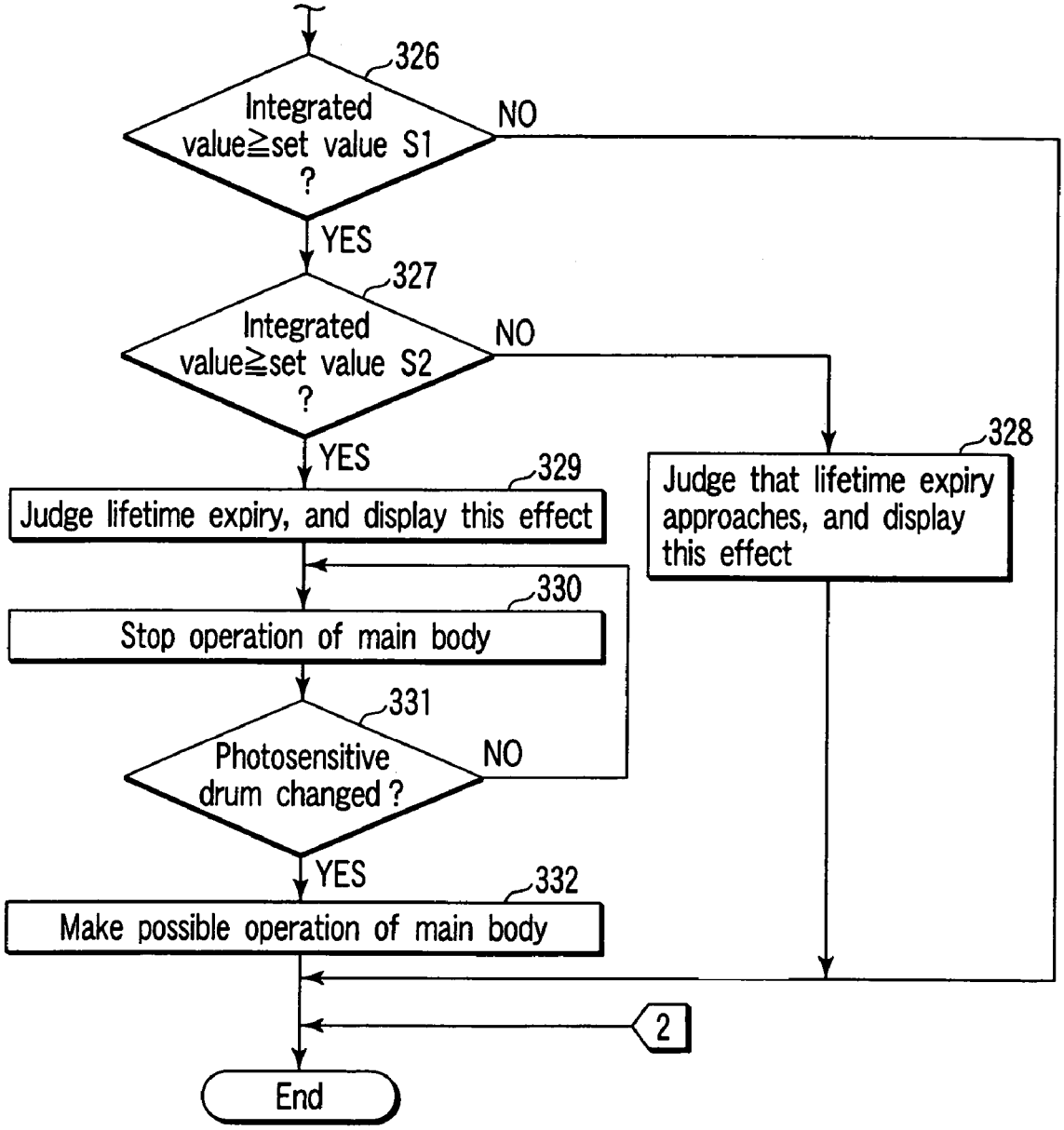
FIG. 16 is a flowchart showing a main part of a function of a sixth embodiment.

Instead of the process of steps 324 and 325 of the fifth embodiment, a process of steps 326 and 327 shown in a flowchart of FIG. 16 is executed. Since other processes are the same as those of the fifth embodiment, the description is omitted.

That is, when the integrated value is less than a predetermined set value S1 (NO in step 326), nothing is displayed judging that the lifetime of a photosensitive drum 20 has not expired.

When the integrated value is not less than the set value S1 (YES in step 326), the integrated value is compared with a predetermined set value S2 (>S1) (step 327). When the integrated value is less than the set value S2 (NO in step 327), it is judged that the photosensitive drum 20 has nearly expired, and the effect is displayed in a display 60 (step 328). By this display, it is notified to the user that the lifetime of the photosensitive drum 20 has nearly expired.

The user can recognize in advance that the photosensitive drum 20 approaches a change time. Accordingly, the user can ask a maintenance serviceman to change the photosensitive drum 20 at a convenient timing.

When the integrated value is not less than the set value S2 (YES in step 327), it is judged that the lifetime of the photosensitive drum 20 has expired, and this effect is displayed in the display 60 (step 329). Moreover, the operation of a main body 1 is stopped (step 330). Unless the photosensitive drum 20 is changed (NO in step 331), an operation stop state of the main body 1 is continued.

When the photosensitive drum 20 is changed (YES in step 331), the operation of the main body 1 is possible (step 332).

[7] A seventh embodiment of the present invention will be described.

The constitution is the same as that of the first embodiment.

Figure 17:
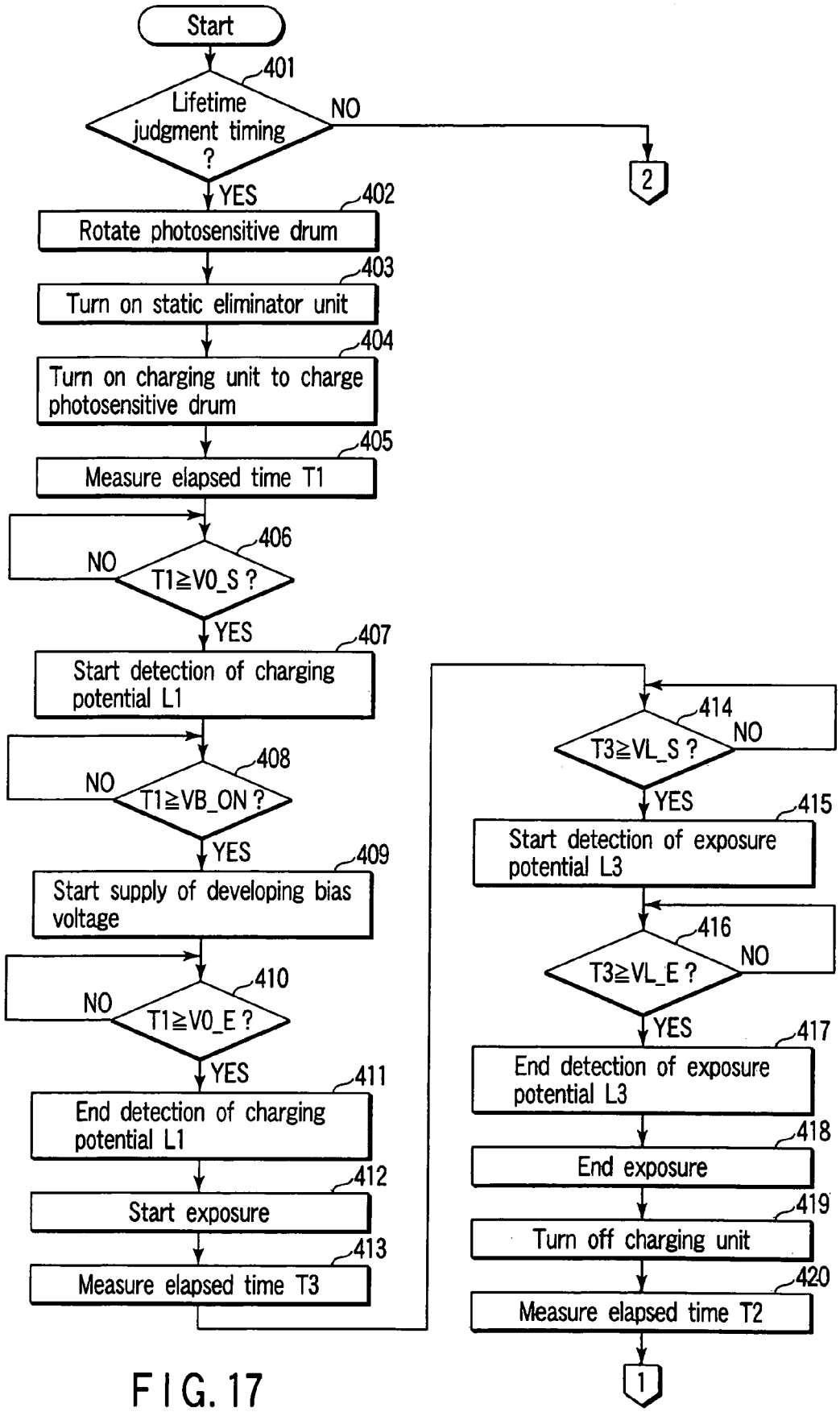
FIG. 17 is a flowchart showing a function of a seventh embodiment.
Figure 18:
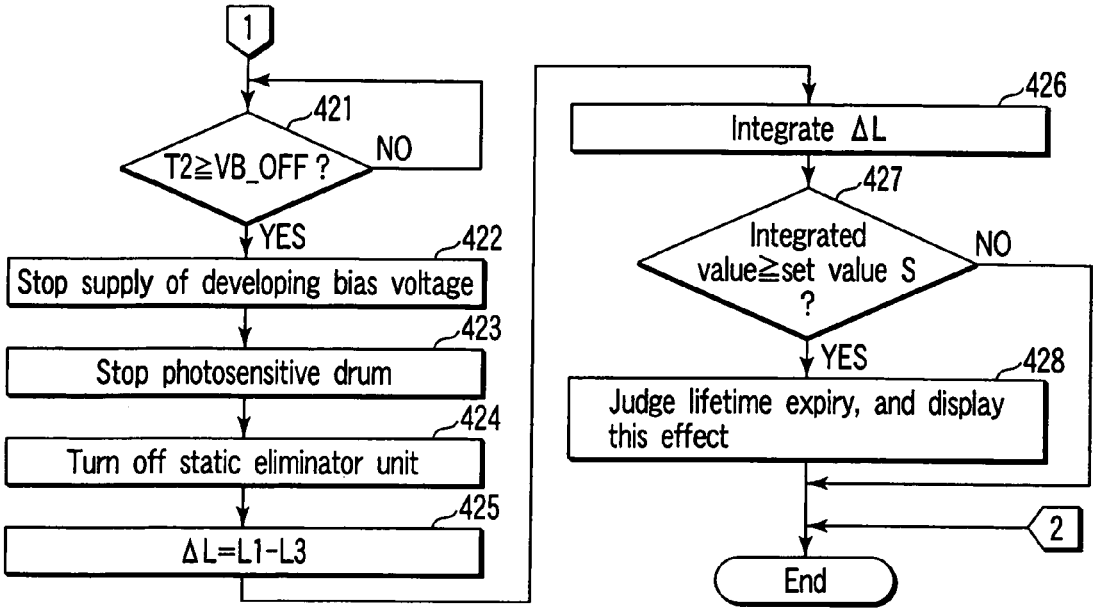
FIG. 18 is a flowchart subsequent to FIG. 17.

A function will be described. A lifetime judgment process of a controller 50 is shown in a flowchart of FIGS. 17 and 18.

In a periodic lifetime detection timing (YES in step 401), rotation of a photosensitive drum 20 is started (step 402), and a static eliminator unit 21 is turned on (step 403).

When the static eliminator unit 21 is turned on, an electric charge remaining on a surface potential of the photosensitive drum 20 is eliminated (static elimination). A predetermined region of the surface of the photosensitive drum 20 subjected to the static elimination is charged by a charging unit 22 (step 404). Moreover, to grasp a detection start timing (step 407) of a charging potential L1, a supply start timing (step 409) of a developing bias voltage, and a detection end timing (step 411) of the charging potential L1, respectively, an elapsed time T1 from when the charging unit 22 turns on is measured (step 405).

The elapsed time T1 from when the charging unit 22 turns on reaches a certain time VO_S or more (YES in step 406), and the detection of the charging potential L1 of the photosensitive drum 20 is started by the potential sensor 23 (step 407).

The detection start timing of the charging potential L1 is determined based on the elapsed time T1 from when the charging unit 22 turns on in this manner, and accordingly the charging potential L1 of a charged region can be correctly detected.

The elapsed time T1 from when the charging unit 22 turns on reaches a certain time VB_ON (YES in step 408), and then the supply of the developing bias voltage with respect to a developing unit 24 is started (step 409). Unless the elapsed time T1 reaches the certain time VB_ON (NO in step 408), the supply of the developing bias voltage to the developing unit 24 is not started.

Unless the elapsed time T1 reaches the certain time VB_ON, the static elimination region of the surface of the photosensitive drum 20 corresponds to the position of the developing unit 24. In this term, no developing bias voltage is supplied to the developing unit 24. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T1 reaches the certain time VB_ON, the charged region of the surface of the photosensitive drum 20 corresponds to the position of the developing unit 24. At this time, the supply of the developing bias voltage to the developing unit 24 is started. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

The elapsed time T1 from when the charging unit 22 turns on reaches the certain time VO_E or more (YES in step 410), and then the detection of the charging potential L1 by the potential sensor 23 is ended (step 411).

The detection end timing of the charging potential L1 is determined based on the elapsed time T1 from when the charging unit 22 turns on, and accordingly the detection of the charging potential L1 is securely completed.

When an exposure start signal LD_ON is supplied to an exposure unit 28 from the controller 50, the charged region of the surface of the photosensitive drum 20 is exposed (step 412). Moreover, to grasp a detection start timing (step 415) of an exposure potential L3 in this exposure region, and a detection end timing (step 417) of the exposure potential L3, respectively, an elapsed time T3 from the start of the exposure is measured (step 413).

When the detection start timing and the detection end timing of the exposure potential L3 are managed based on the elapsed time T3 from the start of the exposure, the time required for the detection of the exposure potential L3 can be minimized. Accordingly, the size of the exposure region can be reduced in such a manner as to be as small as possible. Since the size of the exposure region can be reduced as much as possible, the amount of the developer attracted to the exposure region can be reduced. Therefore, the developer can be inhibited from being wasted.

When the elapsed time T3 from the exposure start reaches a certain time VL_S or more (YES in step 414), the detection of the exposure potential L3 in the exposure region of the photosensitive drum 20 is started (step 415).

When the elapsed time T3 reaches a certain time VL_E or more (YES in step 416), the detection of the exposure potential L3 is ended (step 417). Moreover, an exposure end signal LD_OFF is supplied to the exposure unit 28 from the controller 50, and the exposure by the exposure unit 28 ends (step 418). Furthermore, the charging unit 22 is turned off (step 419).

Moreover, to grasp a supply stop timing (step 422) of the developing bias voltage, an elapsed time T2 from when the charging unit 22 turns off is measured (step 420).

The elapsed time T2 from when the charging unit 22 turns off reaches a certain time VB_OFF (YES in step 421), and then the supply of the developing bias voltage with respect to the developing unit 24 is stopped (step 422). Unless the elapsed time T2 reaches the certain time VB_OFF (NO in step 421), the supply of the developing bias voltage to the developing unit 24 is continued.

Unless the elapsed time T2 reaches the certain time VB_OFF, the charged region of the surface of the photosensitive drum 20 corresponds to the position of the developing unit 24. In this term, the supply of the developing bias voltage to the developing unit 24 is continued. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

When the elapsed time T2 reaches the certain time VB_OFF, the static elimination region of the surface of the photosensitive drum 20 corresponds to the position of the developing unit 24. At this time, the supply of the developing bias voltage to the developing unit 24 is stopped. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

After the supply of the developing bias voltage to the developing unit 24 is stopped, the rotation of the photosensitive drum 20 is stopped (step 423), and the static eliminator unit 21 is turned off (step 424).

Moreover, a difference ΔL (=L1−L3) between the detected charging potential L1 and the detected exposure potential L3 is calculated (step 425).

The calculated potential difference ΔL is integrated (step 426), and an integrated value is compared with a predetermined set value S (step 427). When the integrated value is not less than the set value S (YES in step 427), it is judged that the lifetime of the photosensitive drum 20 has expired, and this effect is displayed in a display 60 (step 428). By this display, the lifetime expiry of the photosensitive drum 20 is notified to the user. The user then asks a maintenance serviceman to change the photosensitive drum 20.

When the integrated value is less than the set value S (NO in step 427), nothing is displayed judging that the lifetime of the photosensitive drum 20 has not expired.

The charging potential L1 is influenced by the residual potential L2, and fluctuates. Therefore, it is difficult to exactly judge the lifetime of the photosensitive drum 20 only by the charging potential L1. Therefore, to cancel the fluctuation of the residual potential L2 which influences the charging potential L1, the exposure potential L3 having a value close to that of the residual potential L2 is subtracted from the charging potential L1, and the integrated value of a subtraction result ΔL (=L1−L3) is used in judging the lifetime of the photosensitive drum 20. The integrated value of the subtraction result ΔL is a value constantly changing in a rising direction, and is easily compared with the set value which is a judgment standard of the lifetime expiry. Therefore, the lifetime of the photosensitive drum 20 can be quickly and correctly judged.

[8] An eighth embodiment of the present invention will be described.

The constitution is the same as that of the first embodiment.

Figure 19:
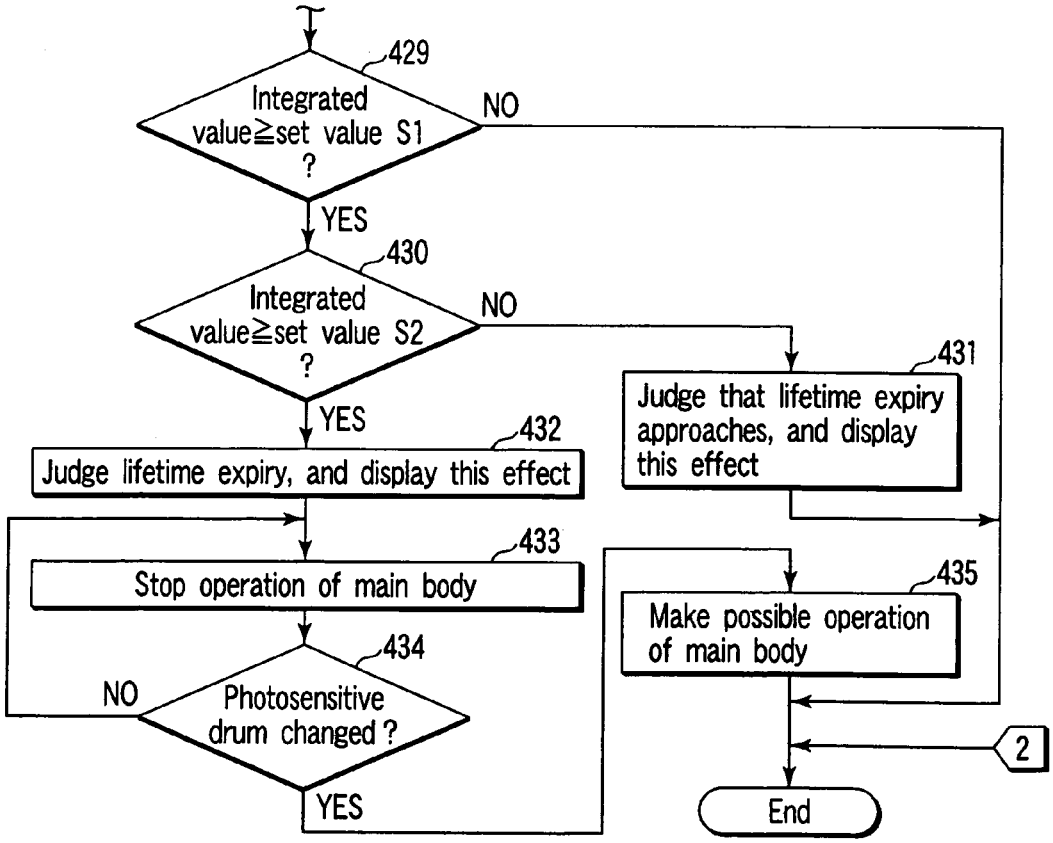
FIG. 19 is a flowchart showing a main part of a function of an eighth embodiment.

Instead of the process of steps 427 and 428 of the seventh embodiment, a process of steps 429 to 435 shown in a flowchart of FIG. 19 is executed. Since other processes are the same as those of the seventh embodiment, the description is omitted.

That is, when the integrated value is less than a predetermined set value S1 (NO in step 429), nothing is displayed judging that the lifetime of a photosensitive drum 20 has not expired.

When the integrated value is not less than the set value S1 (YES in step 429), the integrated value is compared with a predetermined set value S2 (>S1) (step 430). When the integrated value is less than the set value S2 (NO in step 430), it is judged that the photosensitive drum 20 has nearly expired, and the effect is displayed in a display 60 (step 431). By this display, it is notified to the user that the lifetime of the photosensitive drum 20 nearly expires.

The user can recognize in advance that the photosensitive drum 20 approaches a change time. Accordingly, the user can ask a maintenance serviceman to change the photosensitive drum 20 at a convenient timing.

When the integrated value is not less than the set value S2 (YES in step 430), it is judged that the lifetime of the photosensitive drum 20 has expired, and this effect is displayed in the display 60 (step 432). Moreover, the operation of a main body 1 is stopped (step 433). Unless the photosensitive drum 20 is changed (NO in step 434), an operation stop state of the main body 1 is continued.

When the photosensitive drum 20 is changed (YES in step 434), the operation of the main body 1 is possible (step 435).

[9] A ninth embodiment of the present invention will be described.

The constitution is the same as that of the first embodiment.

Figure 20:
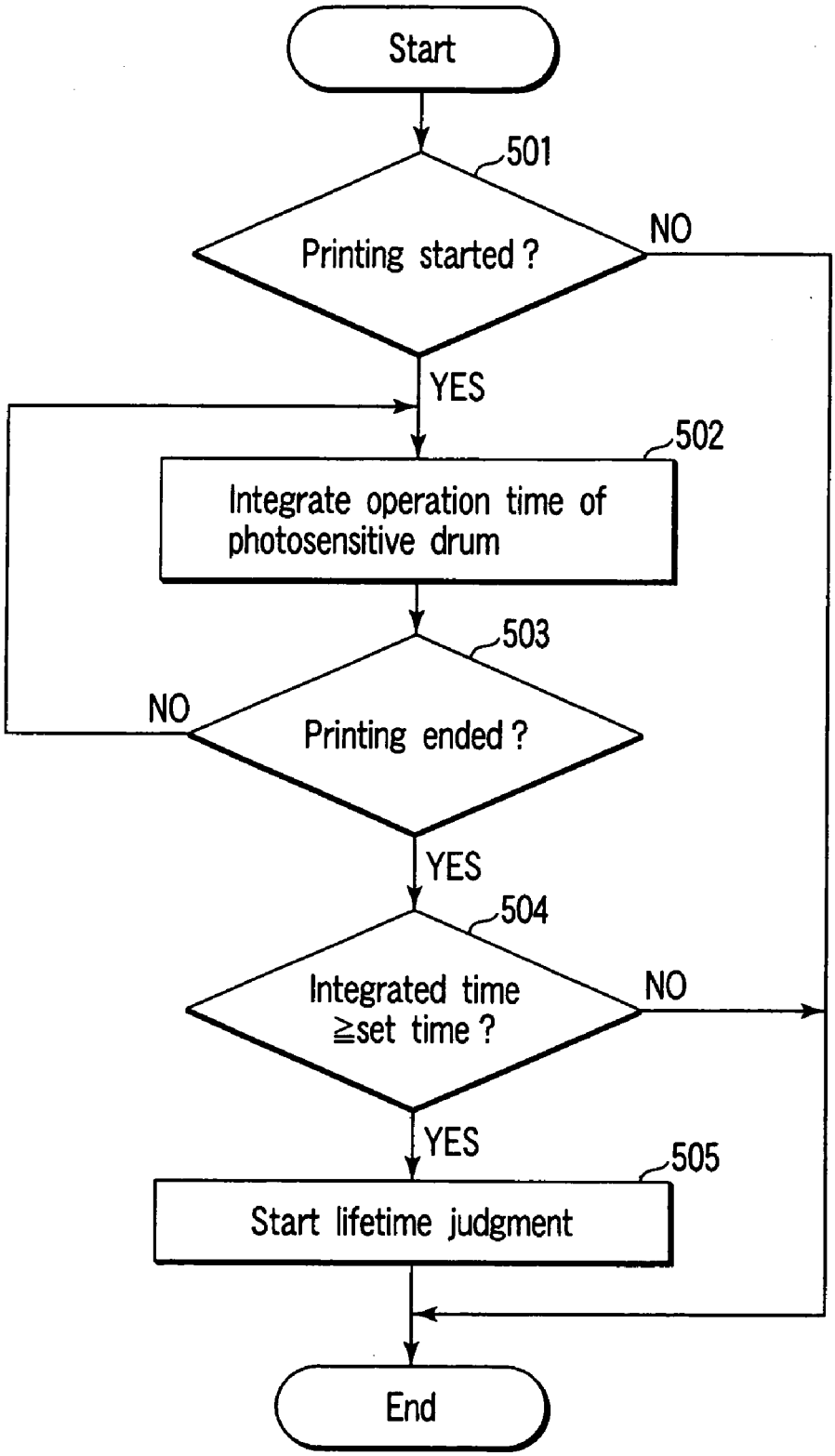
FIG. 20 is a flowchart showing a function of a ninth embodiment.

A function will be described. A part of a lifetime judgment process of a controller 50 is shown in a flowchart of FIG. 20.

When printing is started (YES in step 501), an operation time of a photosensitive drum 20 is integrated (step 502) until the printing ends (YES in step 503). When an integrated time is not less than a predetermined set value (YES in step 504), the lifetime judgment according to any of the first, second, third, and fourth embodiments is started (step 505).

According to this ninth embodiment, redundant lifetime judgment is prevented in a state in which there is no fear of lifetime expiry of the photosensitive drum 20.

[10] A tenth embodiment of the present invention will be described.

The constitution is the same as that of the first embodiment.

Figure 21:
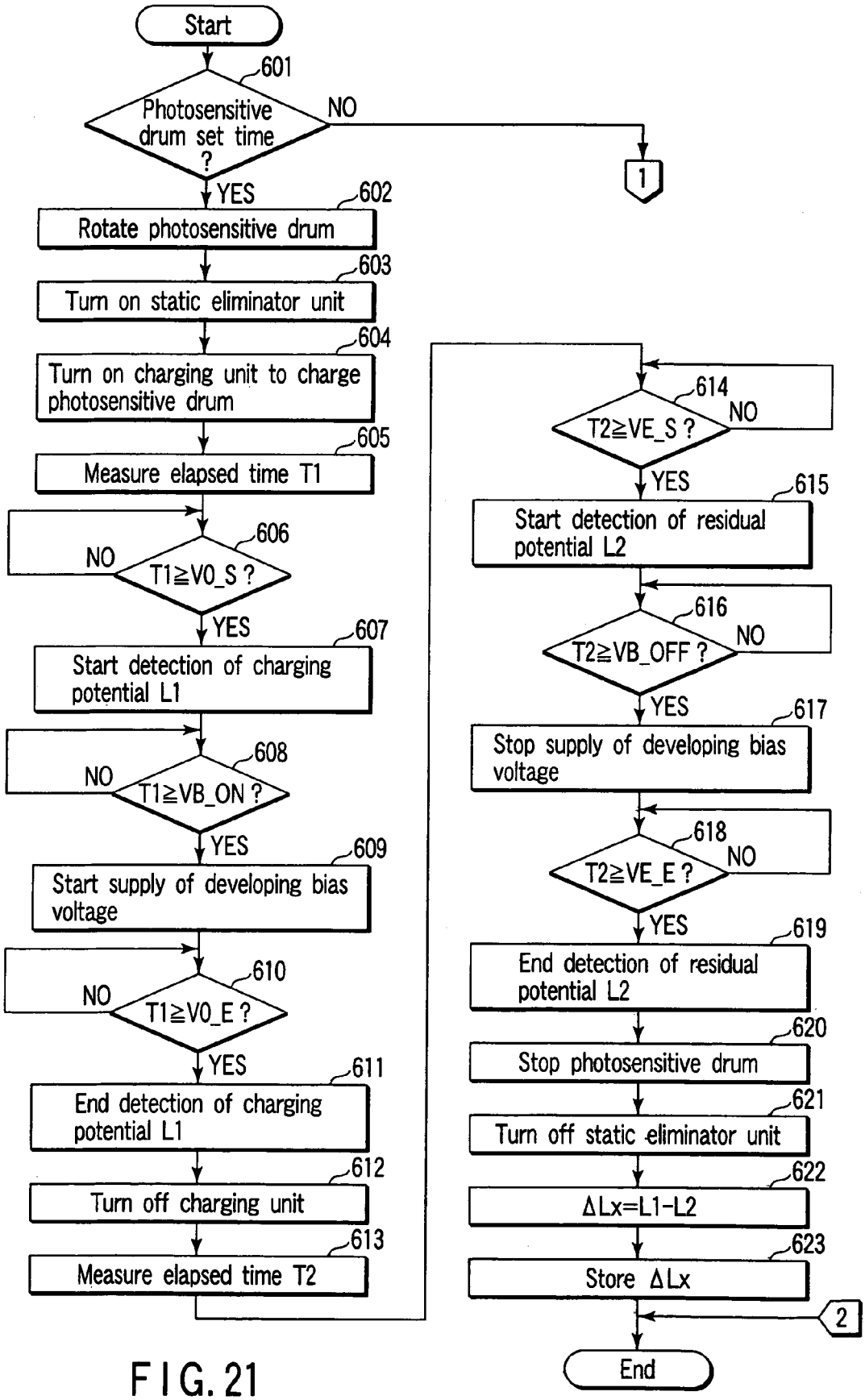
FIG. 21 is a flowchart showing a function of a tenth embodiment.
Figure 22:
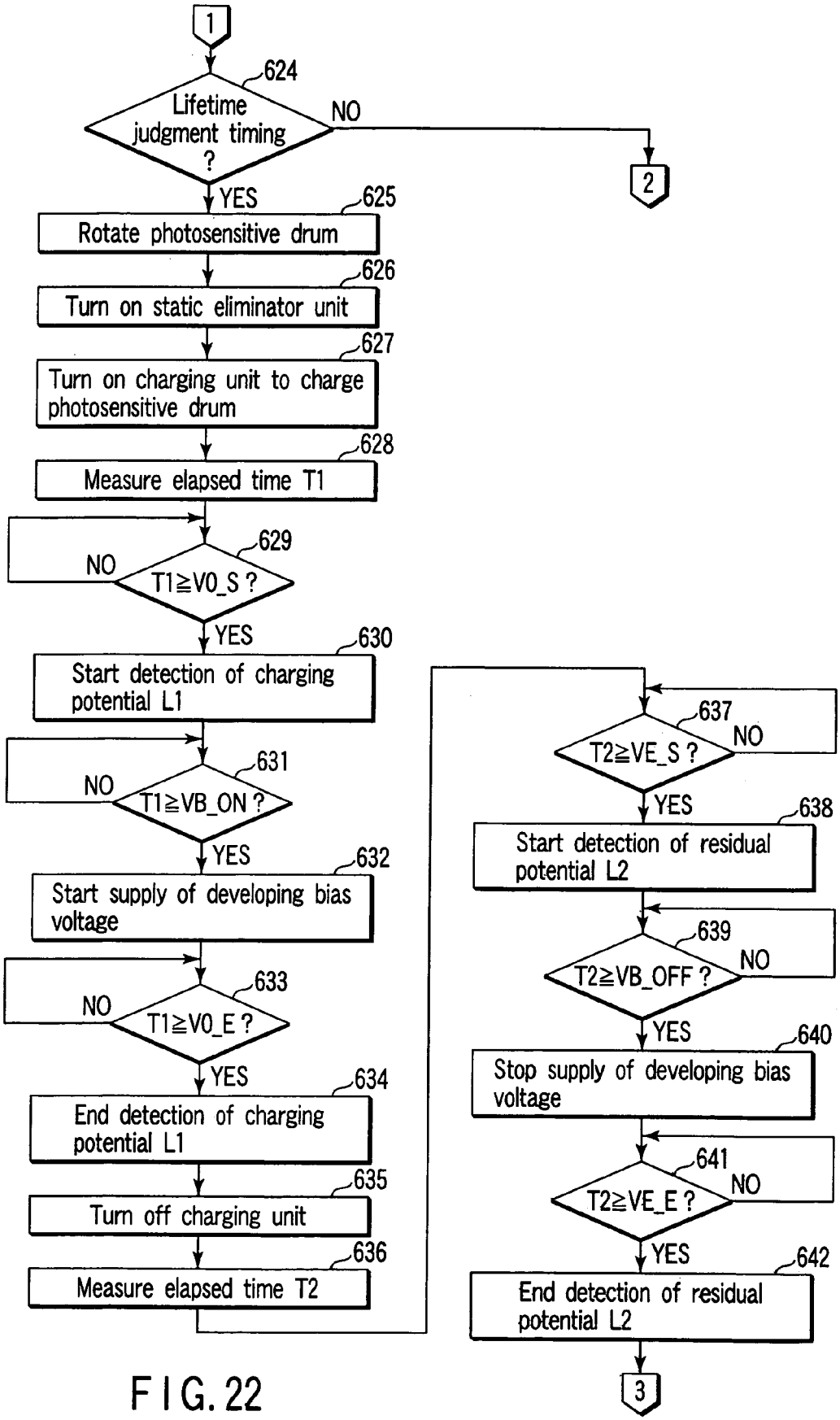
FIG. 22 is a flowchart subsequent to FIG. 21.
Figure 23:
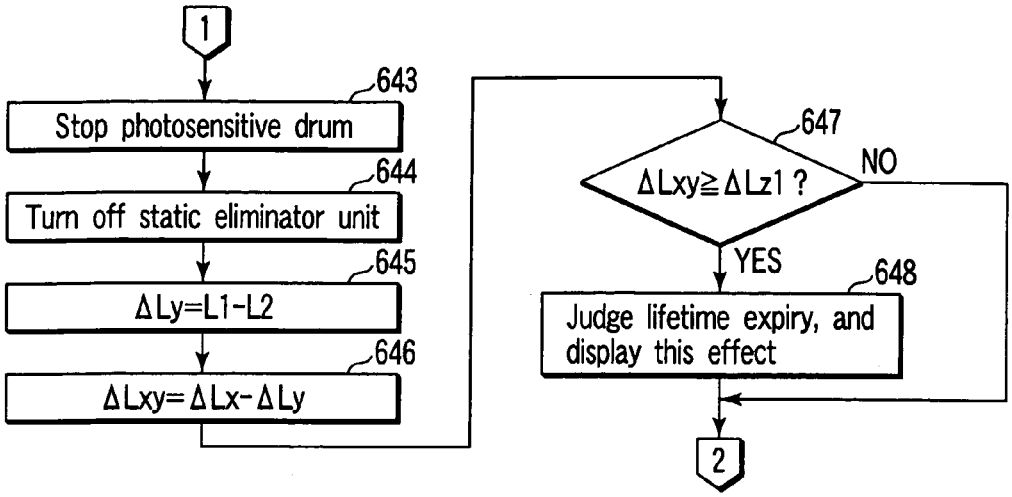
FIG. 23 is a flowchart subsequent to FIGS. 21 and 22.

A function will be described. A lifetime judgment process of a controller 50 is shown in a flowchart of FIGS. 21, 22, and 23.

When a new photosensitive drum 20 is set to a main body 1 at a shipping time of the main body 1 or a change time of the photosensitive drum 20 (YES in step 601), rotation of the photosensitive drum 20 is started (step 602), and a static eliminator unit 21 is turned on (step 603).

When the static eliminator unit 21 is turned on, electric charges remaining on the surface of the photosensitive drum 20 are eliminated (static elimination). Moreover, a charging unit 22 is turned on. When the charging unit 22 is turned on, a predetermined region of the surface of the photosensitive drum 20 subjected to the static elimination is charged (step 604). To grasp a detection start timing (step 607) of a charging potential L1 of the charged region, a supply start timing (step 609) of a developing bias voltage, and a detection end timing (step 611) of the charging potential L1, respectively, an elapsed time T1 from when the charging unit 22 turns on is measured (step 605).

The elapsed time T1 from when the charging unit 22 turns on reaches a certain time VO_S or more (YES in step 606), and the charging potential L1 of the photosensitive drum 20 is detected by a potential sensor 23 (step 607).

The detection start timing of the charging potential L1 is determined based on the elapsed time T1 from when the charging unit 22 turns on in this manner, and accordingly the charging potential L1 of the charged region can be correctly detected.

The elapsed time T1 from when the charging unit 22 turns on reaches a certain time VB_ON (YES in step 608), and then the supply of the developing bias voltage with respect to a developing unit 24 is started (step 609). Unless the elapsed time T1 reaches the certain time VB_ON (NO in step 608), any developing bias voltage is not supplied to the developing unit 24.

Unless the elapsed time T1 reaches the certain time VB_ON, the static elimination region of the surface of the photosensitive drum 20 corresponds to the position of the developing unit 24. In this term, any developing bias voltage is not supplied to the developing unit 24. Therefore, any developer (toner and carrier, especially carrier) is not attracted by the static elimination region of the surface of the photosensitive drum 20. Therefore, soiling of the photosensitive drum 20 by the developer can be prevented, and further the developer can be prevented from being wasted.

When the elapsed time T1 reaches the certain time VB_ON, the charged region of the surface of the photosensitive drum 20 corresponds to the position of the developing unit 24. At this time, the supply of the developing bias voltage to the developing unit 24 is started. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

The elapsed time T1 from when the charging unit 22 turns on reaches the certain time VO_E or more (YES in step 610), and then the detection of the charging potential L1 of the photosensitive drum 20 is ended (step 611).

The detection end timing of the charging potential L1 is determined based on the elapsed time T1 from when the charging unit 22 turns on in this manner, and accordingly the detection of the charging potential L1 is securely completed.

When the detection of the charging potential L1 by the potential sensor 23 ends, the charging unit 22 is turned off (step 612). Moreover, to grasp a detection start timing (step 615) of a residual potential L2, a supply stop timing (step 617) of the developing bias voltage, and a detection end timing (step 619) of the residual potential L2, respectively, an elapsed time T2 from when the charging unit 22 turns off is measured (step 613).

When the elapsed time T2 reaches a certain time VE_S or more (YES in step 614), the residual potential L2 of the photosensitive drum 20 is detected by the potential sensor 23 (step 615).

The detection start timing of the residual potential L2 is determined based on the elapsed time T2 from when the charging unit 22 turns off in this manner, and accordingly the residual potential L2 of the static elimination region can be correctly detected. The elapsed time T2 from when the charging unit 22 turns off reaches a certain time $VB_{13}$ OFF (YES in step 616), and then the supply of the developing bias voltage with respect to the developing unit 24 is stopped (step 617). Unless the elapsed time T2 reaches the certain time $VB_{13}$ OFF (NO in step 616), the supply of the developing bias voltage to the developing unit 24 is continued.

Unless the elapsed time T2 reaches the certain time VB_OFF, the charged region of the surface of the photosensitive drum 20 corresponds to the position of the developing unit 24. In this term, the supply of the developing bias voltage to the developing unit 24 is continued. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

When the elapsed time T2 reaches the certain time VB_OFF, the static elimination region of the surface of the photosensitive drum 20 corresponds to the position of the developing unit 24. At this time, the supply of the developing bias voltage to the developing unit 24 is stopped. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T2 reaches the certain time VE_E or more (YES in step 618), the detection of the residual potential L2 by the potential sensor 23 is ended (step 619).

The detection end timing of the residual potential L2 is determined based on the elapsed time T2 from when the charging unit 22 turns off, and accordingly the detection of the residual potential L2 is securely completed.

When the detection of the residual potential L2 ends, the rotation of the photosensitive drum 20 is stopped (step 620), and the static eliminator unit 21 is turned off (step 621).

Moreover, a difference ΔLx (=L1−L2) between the detected charging potential L1 and the detected residual potential L2 is calculated (step 622).

The calculated potential difference ΔLx is stored as an initial value in an internal memory of the controller 50 (step 623).

Thereafter, in a periodic lifetime judgment timing (YES in step 624), the rotation of the photosensitive drum 20 is started (step 625), and the static eliminator unit 21 is turned on (step 626). When the static eliminator unit 21 is turned on, the electric charge remaining on the surface of the photosensitive drum 20 is eliminated (static elimination). Moreover, the charging unit 22 is turned on. When the charging unit 22 is turned on, the predetermined region of the surface of the photosensitive drum 20 subjected to the static elimination is charged (step 627). To grasp a detection start timing (step 630) of a charging potential L1 of the charged region, a supply start timing (step 632) of the developing bias voltage, and a detection end timing (step 634) of the charging potential L1, respectively, an elapsed time T1 from when the charging unit 22 turns on is measured (step 628).

The elapsed time T1 from when the charging unit 22 turns on reaches a certain time VO_S or more (YES in step 629), and the charging potential L1 of the photosensitive drum 20 is detected by the potential sensor 23 (step 630).

The detection start timing of the charging potential L1 is determined based on the elapsed time T1 from when the charging unit 22 turns on in this manner, and accordingly the charging potential L1 can be correctly detected.

The elapsed time T1 from when the charging unit 22 turns on reaches a certain time VB_ON (YES in step 631), and then the supply of the developing bias voltage with respect to the developing unit 24 is started (step 632). Unless the elapsed time T1 reaches the certain time VB_ON (NO in step 631), no developing bias voltage is supplied to the developing unit 24.

Unless the elapsed time T1 reaches the certain time VB_ON, the static elimination region of the surface of the photosensitive drum 20 corresponds to the position of the developing unit 24. In this term, no developing bias voltage is supplied to the developing unit 24. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T1 reaches the certain time VB_ON, the charged region of the surface of the photosensitive drum 20 corresponds to the position of the developing unit 24. At this time, the supply of the developing bias voltage with respect to the developing unit 24 is started. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

The elapsed time T1 from when the charging unit 22 turns on reaches the certain time VO_E or more (YES in step 633), and then the detection of the charging potential L1 of the photosensitive drum 20 is ended (step 634).

The detection end timing of the charging potential L1 is determined based on the elapsed time T1 from when the charging unit 22 turns on in this manner, and accordingly the detection of the charging potential L1 is securely completed.

When the detection of the charging potential L1 by the potential sensor 23 ends, the charging unit 22 is turned off (step 635). Moreover, to grasp a detection start timing (step 637) of a residual potential L2, a supply stop timing (step 640) of the developing bias voltage, and a detection end timing (step 642) of the residual potential L2, respectively, an elapsed time T2 from when the charging unit 22 turns off is measured (step 636).

The elapsed time T2 reaches a certain time VE_S or more (YES in step 637), and the residual potential L2 of the photosensitive drum 20 is detected by the potential sensor 23 (step 638).

The detection start timing of the residual potential L2 is determined based on the elapsed time T2 from when the charging unit 22 turns off in this manner, and accordingly the residual potential L2 of the static elimination region can be correctly detected.

The elapsed time T2 from when the charging unit 22 turns off reaches a certain time VB_OFF (YES in step 639), and then the supply of the developing bias voltage with respect to the developing unit 24 is stopped (step 640). Unless the elapsed time T2 reaches the certain time VB_OFF (NO in step 639), the supply of the developing bias voltage to the developing unit 24 is continued.

Unless the elapsed time T2 reaches the certain time VB_OFF, the charged region of the surface of the photosensitive drum 20 corresponds to the position of the developing unit 24. In this term, the supply of the developing bias voltage to the developing unit 24 is continued. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

When the elapsed time T2 reaches the certain time VB_OFF, the static elimination region of the surface of the photosensitive drum 20 corresponds to the position of the developing unit 24. At this time, the supply of the developing bias voltage to the developing unit 24 is stopped.

Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T2 reaches the certain time VE_E or more (YES in step 641), the detection of the residual potential L2 by the potential sensor 23 is ended (step 642).

The detection end timing of the residual potential L2 is determined based on the elapsed time T2 from when the charging unit 22 turns off in this manner, and accordingly the detection of the residual potential L2 is securely completed.

When the detection of the residual potential L2 ends, the rotation of the photosensitive drum 20 is stopped (step 643), and the static eliminator unit 21 is turned off (step 644).

Moreover, a difference ΔLy (=L1−L2) between the charging potential L1 detected in the step 630 and the residual potential L2 detected in the step 638 is calculated (step 645).

The calculated potential difference ΔLy is subtracted from the potential difference ΔLx stored as the initial value (step 646). When this subtraction result ΔLxy (=ΔLx−ΔLy) is not less than a predetermined set value ΔLz1 (YES in step 647), the lifetime expiry of the photosensitive drum 20 is judged, and this effect is displayed in a display 60 (step 648). By this display, the lifetime expiry of the photosensitive drum 20 is notified to the user. The user then asks a maintenance serviceman to change the photosensitive drum 20.

When the subtraction result ΔLxy is less than a set value ΔLz1 (NO in step 647), nothing is displayed judging that the lifetime of the photosensitive drum 20 has not expired.

As described above, the difference ΔLx between the initial charging potential L1 at the time when the new photosensitive drum 20 has been set, and the residual potential L2 is stored as the initial value, the subsequent difference ΔLy between the charging potential L1 and the residual potential L2 is subtracted from the initial value ΔLx, and the subtraction result ΔLxy (=ΔLx−ΔLy) is used in judging the lifetime of the photosensitive drum 20. Therefore, the lifetime of the photosensitive drum 20 can be quickly and correctly judged regardless of a solid difference of the photosensitive drum 20.

[11] An eleventh embodiment of the present invention will be described.

The constitution is the same as that of the first embodiment.

Figure 24:
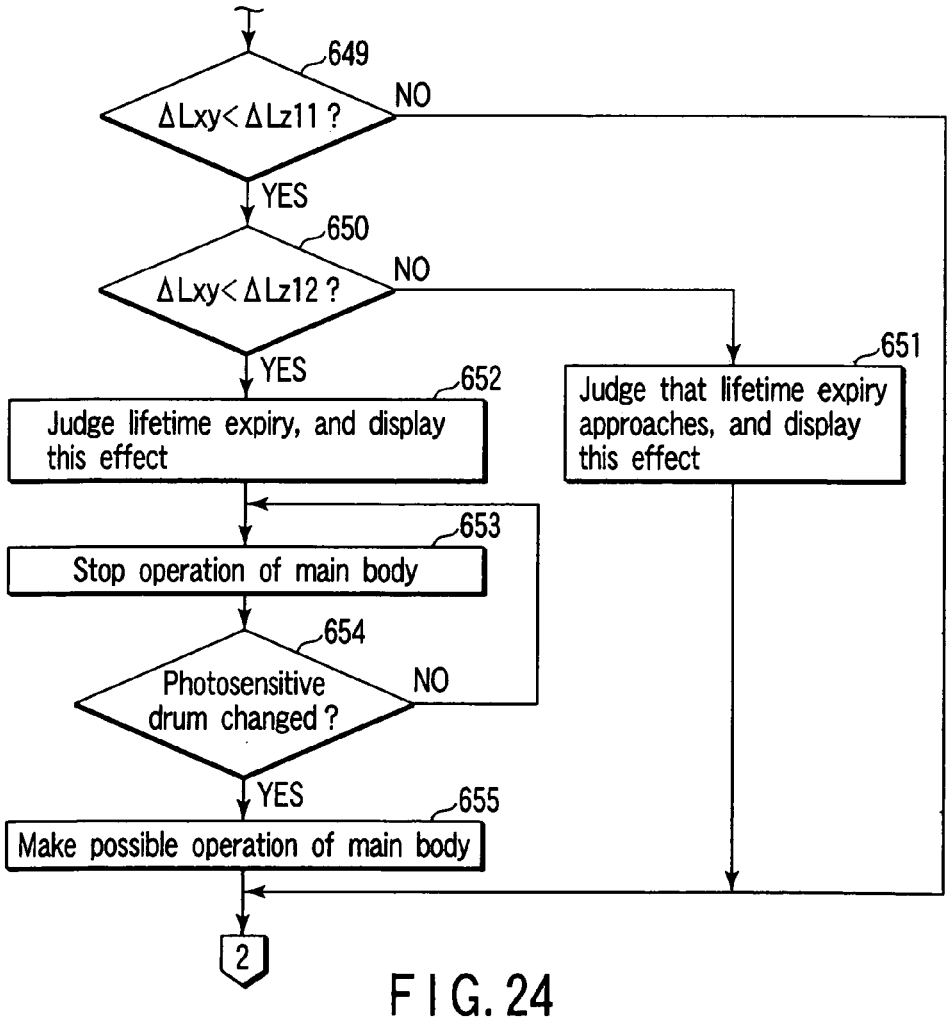
FIG. 24 is a flowchart showing a main part of a function of an eleventh embodiment.

Instead of the process of steps 647 and 638 of the tenth embodiment, a process of steps 649 to 655 shown in a flowchart of FIG. 24 is executed. Since other processes are the same as those of the tenth embodiment, the description is omitted.

That is, when the subtraction result ΔLxy is less than a predetermined set value ΔLz11 (NO in step 649), nothing is displayed judging that the lifetime of a photosensitive drum 20 has not expired.

When the subtraction result ΔLxy is not less than the set value ΔLz11 (YES in step 649), the subtraction result ΔLxy is compared with a predetermined set value ΔLz12 (>ΔLz11) (step 650). When the subtraction result ΔLxy is less than the set value ΔLz12 (NO in step 650), it is judged that the photosensitive drum 20 has nearly expired, and this effect is displayed in a display 60 (step 651). By this display, it is notified to the user that the lifetime of the photosensitive drum 20 has nearly expired.

The user can recognize in advance that the photosensitive drum 20 approaches a change time. Accordingly, the user can ask a maintenance serviceman to change the photosensitive drum 20 at a convenient timing.

When the subtraction result ΔLxy is not less than the set value ΔLz12 (YES in step 650), it is judged that the lifetime of the photosensitive drum 20 has expired, and this effect is displayed in the display 60 (step 652). Moreover, the operation of a main body 1 is stopped (step 653). Unless the photosensitive drum 20 is changed (NO in step 654), an operation stop state of the main body 1 is continued.

When the photosensitive drum 20 is changed (YES in step 654), the operation of the main body 1 is possible (step 655).

[12] A twelfth embodiment of the present invention will be described.

The constitution is the same as that of the first embodiment.

Figure 25:
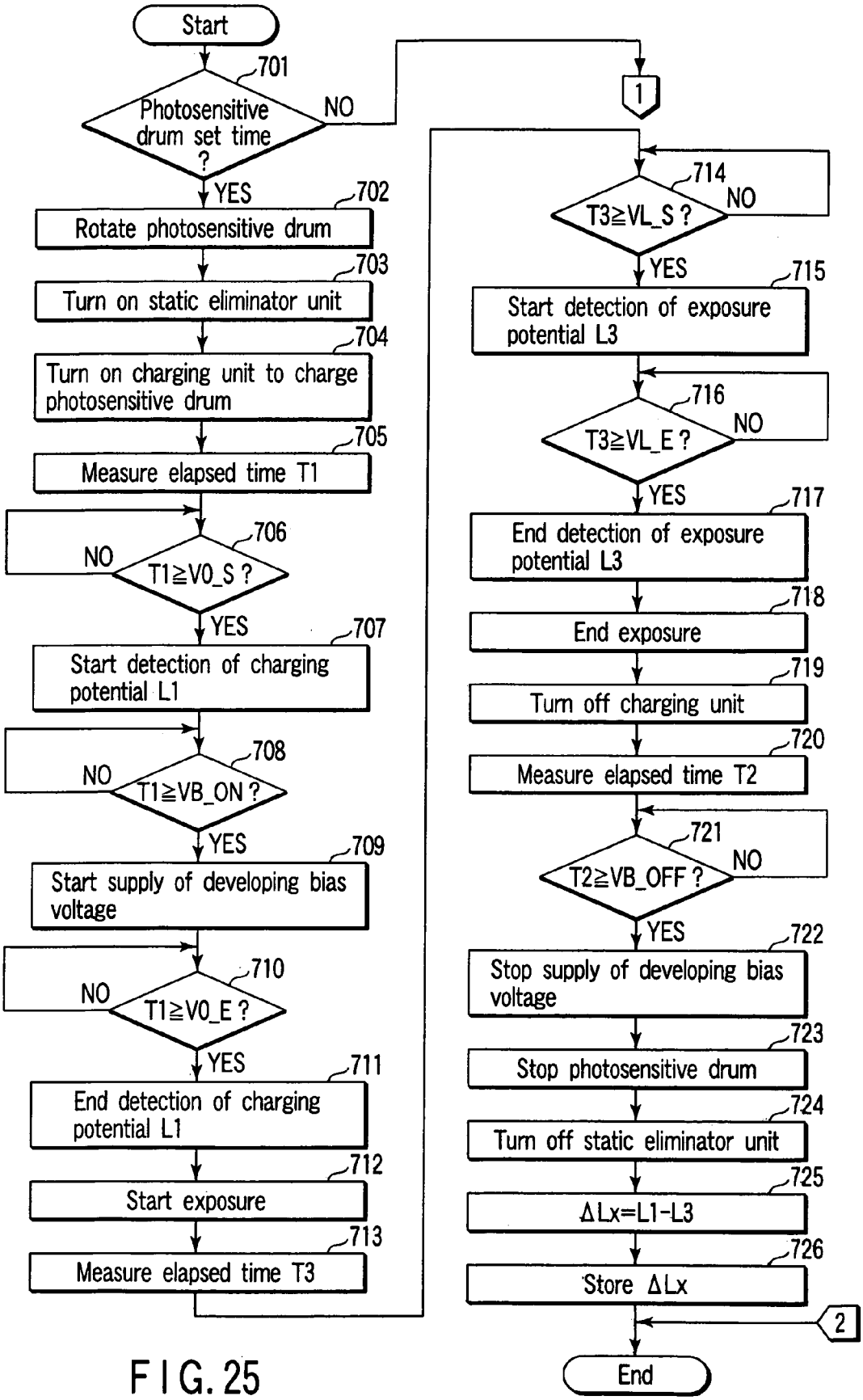
FIG. 25 is a flowchart showing a function of a twelfth embodiment.
Figure 26:
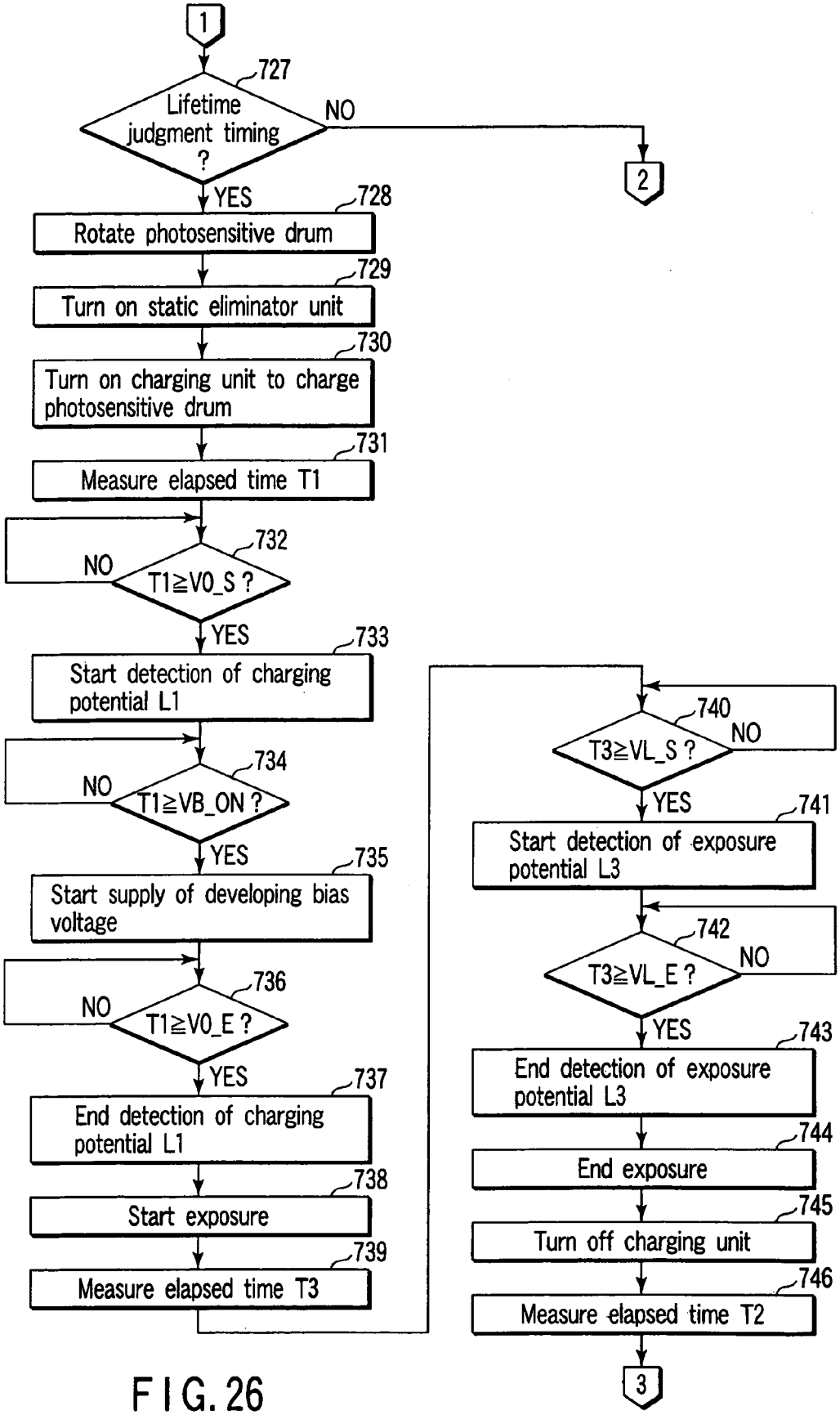
FIG. 26 is a flowchart subsequent to FIG. 25.
Figure 27:
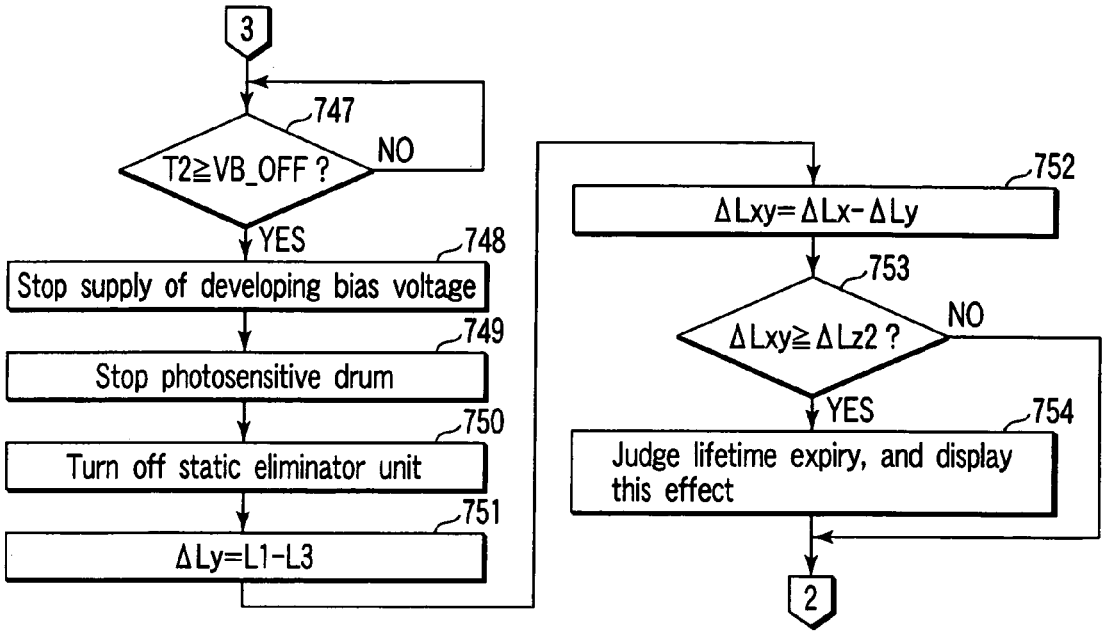
FIG. 27 is a flowchart subsequent to FIGS. 25 and 26.

A function will be described. A lifetime judgment process of a controller 50 is shown in a flowchart of FIGS. 25, 26, and 27.

When a new photosensitive drum 20 is set in a main body 1 at shipping time of the main body 1 or a change time of the photosensitive drum 20 (YES in step 701), rotation of the photosensitive drum 20 is started (step 702), and a static eliminator unit 21 is turned on (step 703).

When the static eliminator unit 21 is turned on, electric charges remaining on the surface potential of the photosensitive drum 20 are eliminated (static elimination). A predetermined region of the surface of the photosensitive drum 20 subjected to the static elimination is charged by a charging unit 22 (step 704). Moreover, to grasp a detection start timing (step 707) of a charging potential L1, a supply start timing (step 709) of a developing bias voltage, and a detection end timing (step 711) of the charging potential L1, respectively, an elapsed time T1 from when the charging unit 22 turns on is measured (step 705).

The elapsed time T1 from when the charging unit 22 turns on reaches a certain time VO_S or more (YES in step 706), and detection of the charging potential L1 of the photosensitive drum 20 is started by a potential sensor 23 (step 707).

The detection start timing of the charging potential L1 is determined based on the elapsed time T1 from when the charging unit 22 turns on in this manner, and accordingly the charging potential L1 of the charged region can be correctly detected.

The elapsed time T1 from when the charging unit 22 turns on reaches a certain time VB_ON (YES in step 708), and then the supply of the developing bias voltage with respect to a developing unit 24 is started (step 709). Unless the elapsed time T1 reaches the certain time VB_ON (NO in step 708), any developing bias voltage is not supplied to the developing unit 24.

Unless the elapsed time T1 reaches the certain time VB_ON, the static elimination region of the surface of the photosensitive drum 20 corresponds to the position of the developing unit 24. In this term, no developing bias voltage is supplied to the developing unit 24. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T1 reaches the certain time VB_ON, the charged region of the surface of the photosensitive drum 20 corresponds to the position of the developing unit 24. At this time, the supply of the developing bias voltage to the developing unit 24 is started. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

The elapsed time T1 from when the charging unit 22 turns on reaches the certain time VO_E or more (YES in step 710), and then the detection of the charging potential L1 by the potential sensor 23 is ended (step 711).

The detection end timing of the charging potential L1 is determined based on the elapsed time T1 from when the charging unit 22 turns on in this manner, and accordingly the detection of the charging potential L1 is securely completed.

When an exposure start signal LD_ON is supplied to an exposure unit 28 from the controller 50, the charged region of the surface of the photosensitive drum 20 is exposed (step 712). Moreover, to grasp a detection start timing (step 715) of an exposure potential L3 in this exposure region, and a detection end timing (step 717) of the exposure potential L3, respectively, an elapsed time T3 from the start of the exposure is measured (step 713).

When the detection start timing and the detection end timing of the exposure potential L3 are managed based on the elapsed time T3 from the start of the exposure, the time required for the detection of the exposure potential L3 can be minimized. Accordingly, the size of the exposure region can be reduced in such a manner as to be as small as possible. Since the size of the exposure region can be reduced as much as possible, the amount of the developer attracted to the exposure region can be reduced. Therefore, the developer can be inhibited from being wasted.

When the elapsed time T3 from the exposure start reaches a certain time VL_S or more (YES in step 714), the detection of the exposure potential L3 in the exposure region of the photosensitive drum 20 is started (step 715).

When the elapsed time T3 reaches a certain time VL_E or more (YES in step 716), the detection of the exposure potential L3 is ended (step 717). Moreover, an exposure end signal LD_OFF is supplied to the exposure unit 28 from the controller 50, and the exposure by the exposure unit 28 ends (step 718). Furthermore, the charging unit 22 is turned off (step 719).

Moreover, to grasp a supply stop timing (step 722) of the developing bias voltage, an elapsed time T2 from when the charging unit 22 turns off is measured (step 720).

The elapsed time T2 from when the charging unit 22 turns off reaches a certain time VB_OFF (YES in step 721), and then the supply of the developing bias voltage with respect to the developing unit 24 is stopped (step 722). Unless the elapsed time T2 reaches the certain time VB_OFF (NO in step 721), the supply of the developing bias voltage to the developing unit 24 is continued.

Unless the elapsed time T2 reaches the certain time VB_OFF, the charged region of the surface of the photosensitive drum 20 corresponds to the position of the developing unit 24. In this term, the supply of the developing bias voltage to the developing unit 24 is continued. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

When the elapsed time T2 reaches the certain time VB_OFF, the static elimination region of the surface of the photosensitive drum 20 corresponds to the position of the developing unit 24. At this time, the supply of the developing bias voltage to the developing unit 24 is stopped. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

After the supply of the developing bias voltage to the developing unit 24 is stopped, the rotation of the photosensitive drum 20 is stopped (step 723), and the static eliminator unit 21 is turned off (step 724).

Moreover, a difference ΔLx (=L1−L3) between the detected charging potential L1 and the detected exposure potential L3 is calculated (step 725).

The calculated potential difference ΔLx is stored as an initial value in an internal memory of the controller 50 (step 726).

Thereafter, in a periodic lifetime detection timing (YES in step 727), the rotation of the photosensitive drum 20 is started (step 728), and the static eliminator unit 21 is turned on (step 729). When the static eliminator unit 21 is turned on, the electric charge remaining on the surface potential of the photosensitive drum 20 is eliminated (static elimination). The predetermined region of the surface of the photosensitive drum 20 subjected to the static elimination is charged by the charging unit 22 (step 730). Moreover, to grasp a detection start timing (step 733) of a charging potential L1, a supply start timing (step 735) of the developing bias voltage, and a detection end timing (step 737) of the charging potential L1, respectively, an elapsed time T1 from when the charging unit 22 turns on is measured (step 731).

The elapsed time T1 from when the charging unit 22 turns on reaches a certain time VO_S or more (YES in step 732), and the detection of the charging potential L1 of the photosensitive drum 20 is started by the potential sensor 23 (step 733).

The detection start timing of the charging potential L1 is determined based on the elapsed time T1 from when the charging unit 22 turns on in this manner, and accordingly the charging potential L1 of the charged region can be correctly detected.

The elapsed time T1 from when the charging unit 22 turns on reaches a certain time VB_ON (YES in step 734), and then the supply of the developing bias voltage with respect to the developing unit 24 is started (step 735). Unless the elapsed time T1 reaches the certain time VB_ON (NO in step 734), no developing bias voltage is supplied to the developing unit 24.

Unless the elapsed time T1 reaches the certain time VB_ON, the static elimination region of the surface of the photosensitive drum 20 corresponds to the position of the developing unit 24. In this term, any developing bias voltage is not supplied to the developing unit 24. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T1 reaches the certain time VB_ON, the charged region of the surface of the photosensitive drum 20 corresponds to the position of the developing unit 24. At this time, the supply of the developing bias voltage with respect to the developing unit 24 is started. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

The elapsed time T1 from when the charging unit 22 turns on reaches the certain time VO_E or more (YES in step 736), and then the detection of the charging potential L1 by the potential sensor 23 is ended (step 737).

The detection end timing of the charging potential L1 is determined based on the elapsed time T1 from when the charging unit 22 turns on in this manner, and accordingly the detection of the charging potential L1 is securely completed.

When the exposure start signal LD_ON is supplied to the exposure unit 28 from the controller 50, the charged region of the surface of the photosensitive drum 20 is exposed (step 738). Moreover, to grasp a detection start timing (step 741) of the exposure potential L3 in this exposure region, and a detection end timing (step 743) of the exposure potential L3, respectively, an elapsed time T3 from the start of the exposure is measured (step 739).

When the detection start timing and the detection end timing of the exposure potential L3 are managed based on the elapsed time T3 from the start of the exposure, the time required for the detection of the exposure potential L3 can be minimized. Accordingly, the size of the exposure region can be reduced in such a manner as to be as small as possible. Since the size of the exposure region can be reduced as much as possible, the amount of the developer attracted to the exposure region can be reduced. Therefore, the developer can be inhibited from being wasted.

When the elapsed time T3 from the exposure start reaches a certain time VL_S or more (YES in step 740), the detection of the exposure potential L3 in the exposure region of the photosensitive drum 20 is started (step 741).

When the elapsed time T3 reaches a certain time VL_E or more (YES in step 742), the detection of the exposure potential L3 is ended (step 743). Moreover, an exposure end signal LD_OFF is supplied to the exposure unit 28 from the controller 50, and the exposure by the exposure unit 28 ends (step 744). Furthermore, the charging unit 22 is turned off (step 745).

Moreover, to grasp a supply stop timing (step 748) of the developing bias voltage, an elapsed time T2 from when the charging unit 22 turns off is measured (step 746).

The elapsed time T2 from when the charging unit 22 turns off reaches a certain time VB_OFF (YES in step 747), and then the supply of the developing bias voltage with respect to the developing unit 24 is stopped (step 748). Unless the elapsed time T2 reaches the certain time VB_OFF (NO in step 747), the supply of the developing bias voltage to the developing unit 24 is continued.

Unless the elapsed time T2 reaches the certain time VB_OFF, the charged region of the surface of the photosensitive drum 20 corresponds to the position of the developing unit 24. In this term, the supply of the developing bias voltage to the developing unit 24 is continued. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

When the elapsed time T2 reaches the certain time VB_OFF, the static elimination region of the surface of the photosensitive drum 20 corresponds to the position of the developing unit 24. At this time, the supply of the developing bias voltage to the developing unit 24 is stopped. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

After the supply of the developing bias voltage to the developing unit 24 is stopped, the rotation of the photosensitive drum 20 is stopped (step 749), and the static eliminator unit 21 is turned off (step 750).

Moreover, a difference ΔLy (=L1−L3) between the charging potential L1 detected in the step 733 and the exposure potential L3 detected in the step 741 is calculated (step 751).

The calculated potential difference ΔLy is subtracted from the potential difference ΔLx stored as the initial value (step 752). When this subtraction result ΔLxy (=ΔLx−ΔLy) is not less than a predetermined set value ΔLz2 (YES in step 753), the lifetime expiry of the photosensitive drum 20 is judged, and this effect is displayed in a display 60 (step 754). By this display, the lifetime expiry of the photosensitive drum 20 is notified to the user. The user then asks a maintenance serviceman to change the photosensitive drum 20.

When the subtraction result ΔLxy is less than a set value ΔLz2 (NO in step 753), nothing is displayed judging that the lifetime of the photosensitive drum 20 has not expired.

As described above, the difference ΔLx between the initial charging potential L1 at the time when the new photosensitive drum 20 has been set, and the exposure potential L3 is stored as the initial value, the subsequent difference ΔLy between the charging potential L1 and the exposure potential L3 is subtracted from the initial value ΔLx, and the subtraction result ΔLxy (=ΔLx−ΔLy) is used in judging the lifetime of the photosensitive drum 20. Therefore, the lifetime of the photosensitive drum 20 can be quickly and correctly judged regardless of a solid difference of the photosensitive drum 20.

[13] A thirteenth embodiment of the present invention will be described.

The constitution is the same as that of the first embodiment.

Figure 28:
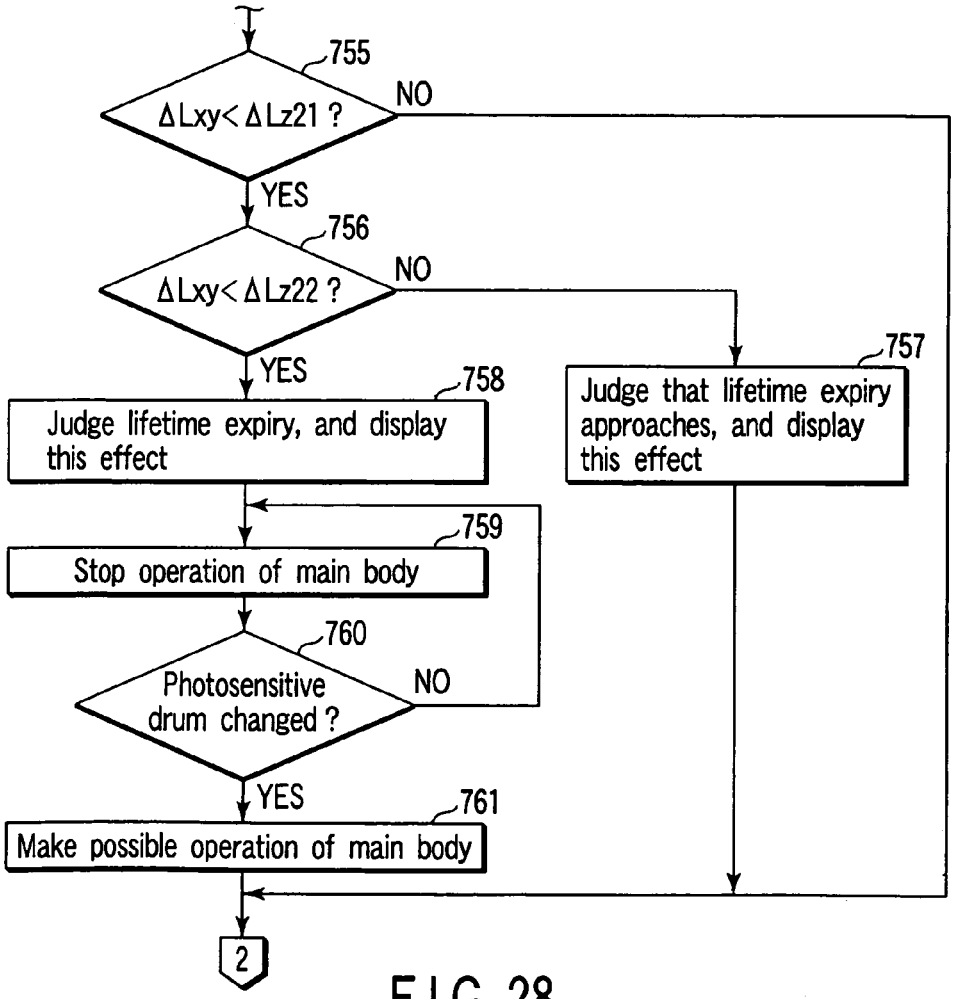
FIG. 28 is a flowchart showing a main part of a function of a thirteenth embodiment.

Instead of the process of steps 753 and 754 of the twelfth embodiment, a process of steps 755 to 761 shown in a flowchart of FIG. 28 is executed. Since other processes are the same as those of the eleventh embodiment, the description is omitted.

That is, when the subtraction result ΔLxy is less than a predetermined set value ΔLz21 (NO in step 755), nothing is displayed judging that the lifetime of a photosensitive drum 20 has not expired.

When the subtraction result ΔLxy is not less than the set value ΔLz21 (YES in step 755), the subtraction result ΔLxy is compared with a predetermined set value ΔLz22 (>ΔLz21) (step 756). When the subtraction result ΔLxy is less than the set value ΔLz22 (NO in step 756), it is judged that the photosensitive drum 20 has nearly expired, and this effect is displayed in a display 60 (step 757). By this display, it is notified to the user that the lifetime of the photosensitive drum 20 has nearly expired.

The user can recognize in advance that the photosensitive drum 20 approaches a change time. Accordingly, the user can ask a maintenance serviceman to change the photosensitive drum 20 at a convenient timing.

When the subtraction result ΔLxy is not less than the set value ΔLz22 (YES in step 756), it is judged that the lifetime of the photosensitive drum 20 has expired, and this effect is displayed in the display 60 (step 758). Moreover, the operation of a main body 1 is stopped (step 759). Unless the photosensitive drum 20 is changed (NO in step 760), an operation stop state of the main body 1 is continued.

When the photosensitive drum 20 is changed (YES in step 760), operation of the main body 1 is possible (step 761).

[14] A fourteenth embodiment of the present invention will be described.

The constitution is the same as that of the first embodiment.

Figure 29:
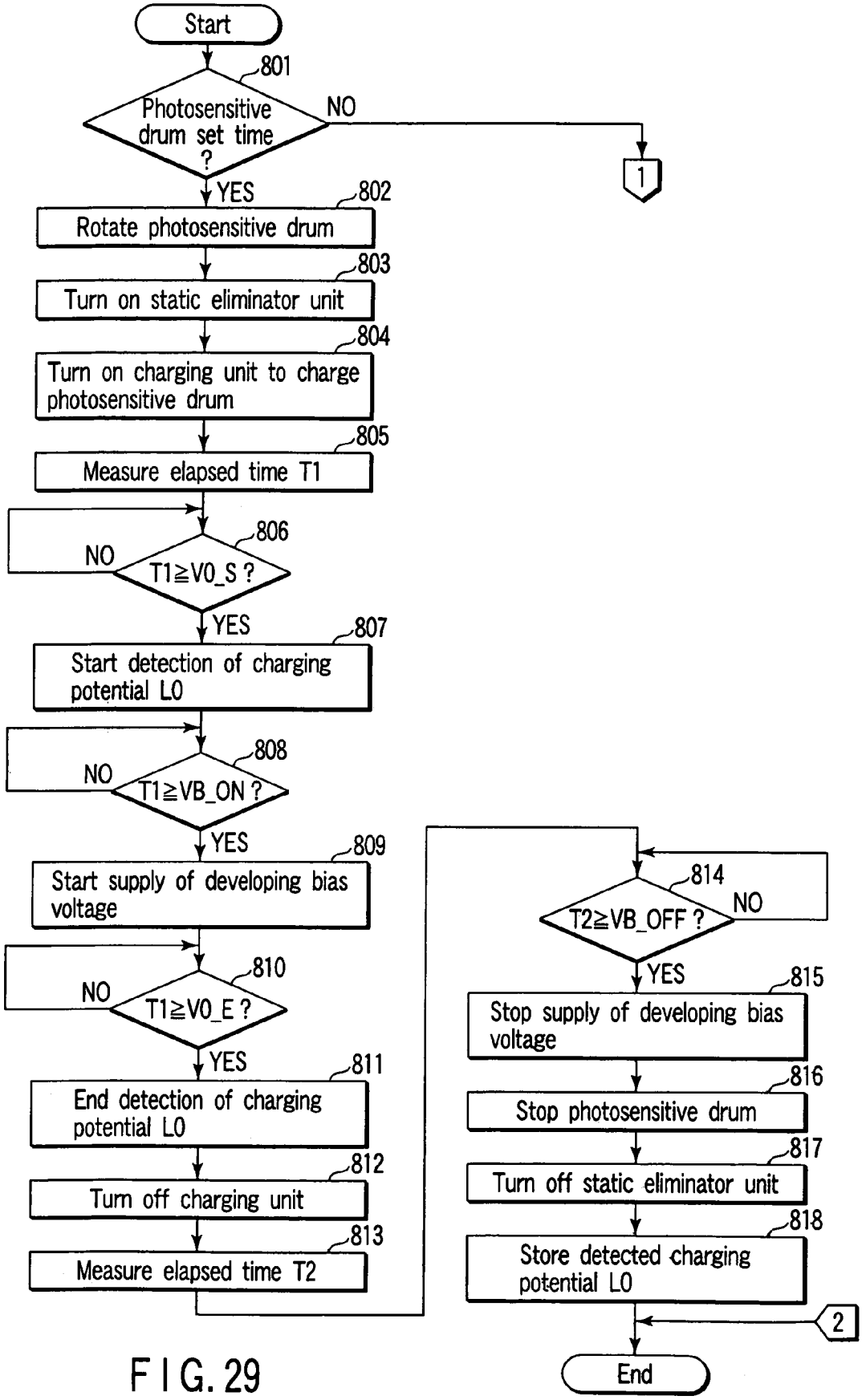
FIG. 29 is a flowchart showing a function of a fourteenth embodiment.
Figure 30:
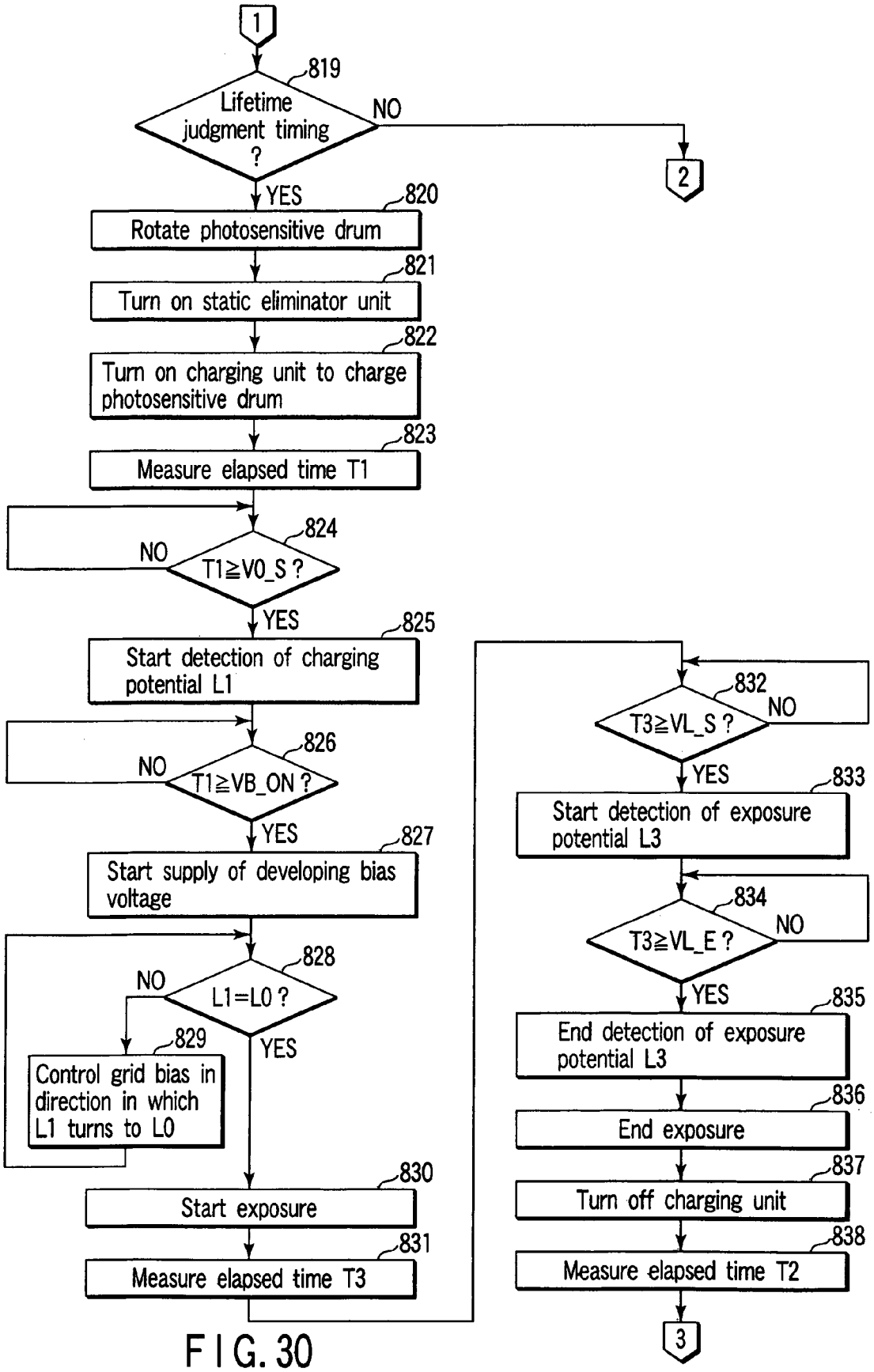
FIG. 30 is a flowchart subsequent to FIG. 29.
Figure 31:
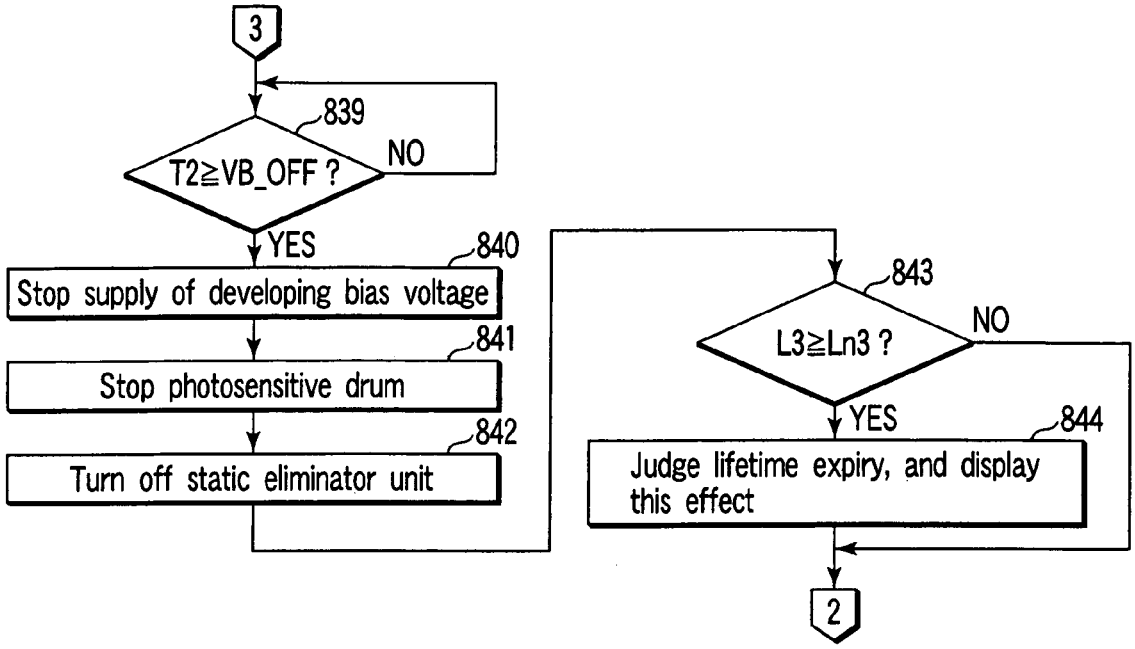
FIG. 31 is a flowchart subsequent to FIGS. 29 and 30.

A function will be described. A lifetime judgment process of a controller 50 is shown in a flowchart of FIGS. 29, 30, and 31.

When a new photosensitive drum 20 is set in a main body 1 at shipping time of the main body 1 or a change time of the photosensitive drum 20 (YES in step 801), rotation of the photosensitive drum 20 is started (step 802), and a static eliminator unit 21 is turned on (step 803). When the static eliminator unit 21 is turned on, electric charges remaining on the surface of the photosensitive drum 20 are eliminated (static elimination). Moreover, a charging unit 22 is turned on. When the charging unit 22 is turned on, a predetermined region of the surface of the photosensitive drum 20 subjected to the static elimination is charged (step 804). To grasp a detection start timing (step 807) of a charging potential L0 of the charged region, a supply start timing (step 809) of a developing bias voltage, and a detection end timing (step 811) of the charging potential L0, respectively, an elapsed time T1 from when the charging unit 22 turns on is measured (step 805).

The elapsed time T1 from when the charging unit 22 turns on reaches a certain time VO_S or more (YES in step 806), and the charging potential L0 of the photosensitive drum 20 is detected by a potential sensor 23 (step 807).

The detection start timing of the charging potential L1 is determined based on the elapsed time T1 from when the charging unit 22 turns on in this manner, and accordingly the charging potential L0 of the charged region can be correctly detected.

The elapsed time T1 from when the charging unit 22 turns on reaches a certain time VB_ON (YES in step 808), and then the supply of the developing bias voltage with respect to a developing unit 24 is started (step 809). Unless the elapsed time T1 reaches the certain time VB_ON (NO in step 808), no developing bias voltage is supplied to the developing unit 24.

Unless the elapsed time T1 reaches the certain time VB_ON, the static elimination region of the surface of the photosensitive drum 20 corresponds to the position of the developing unit 24. In this term, no developing bias voltage is supplied to the developing unit 24. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T1 reaches the certain time VB_ON, the charged region of the surface of the photosensitive drum 20 corresponds to the position of the developing unit 24. At this time, the supply of the developing bias voltage to the developing unit 24 is started. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

The elapsed time T1 from when the charging unit 22 turns on reaches the certain time VO_E or more (YES in step 810), and then the detection of the charging potential L0 by the potential sensor 23 is ended (step 811).

The detection end timing of the charging potential L0 is determined based on the elapsed time T1 from when the charging unit 22 turns on in this manner, and accordingly the detection of the charging potential L0 is securely completed.

When the detection of the charging potential L0 by the potential sensor 23 ends, the charging unit 22 is turned off (step 812). Moreover, to grasp a supply stop timing (step 815) of the developing bias voltage, an elapsed time T2 from when the charging unit 22 turns off is measured (step 813).

The elapsed time T2 from when the charging unit 22 turns off reaches a certain time VB_OFF (YES in step 814), and then the supply of the developing bias voltage with respect to the developing unit 24 is stopped (step 815). Unless the elapsed time T2 reaches the certain time VB_OFF (NO in step 814), the supply of the developing bias voltage to the developing unit 24 is continued.

Unless the elapsed time T2 reaches the certain time VB_OFF, the charged region of the surface of the photosensitive drum 20 corresponds to the position of the developing unit 24. In this term, the supply of the developing bias voltage to the developing unit 24 is continued. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

When the elapsed time T2 reaches the certain time VB_OFF, the static elimination region of the surface of the photosensitive drum 20 corresponds to the position of the developing unit 24. At this time, the supply of the developing bias voltage to the developing unit 24 is stopped. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

After the supply of the developing bias voltage to the developing unit 24 is stopped, the rotation of the photosensitive drum 20 is stopped (step 816), and the static eliminator unit 21 is turned off (step 817). Moreover, the detected charging potential L0 is stored as an initial value in an internal memory of the 50 (step 818).

In a periodic lifetime detection timing (YES in step 819), the rotation of the photosensitive drum 20 is started (step 820), and the static eliminator unit 21 is turned on (step 821). When the static eliminator unit 21 is turned on, the electric charge remaining on the surface potential of the photosensitive drum 20 is eliminated (static elimination). The predetermined region of the surface of the photosensitive drum 20 subjected to the static elimination is charged by the charging unit 22 (step 822). Moreover, to grasp a detection start timing (step 825) of a charging potential L1, and a supply start timing (step 827) of the developing bias voltage, respectively, an elapsed time T1 from when the charging unit 22 turns on is measured (step 823).

The elapsed time T1 from when the charging unit 22 turns on reaches a certain time VO_S or more (YES in step 824), and the detection of the charging potential L1 of the photosensitive drum 20 is started by the potential sensor 23 (step 825).

The elapsed time T1 from when the charging unit 22 turns on reaches a certain time VB_ON (YES in step 826), and then the supply of the developing bias voltage with respect to the developing unit 24 is started (step 827). Unless the elapsed time T1 reaches the certain time VB_ON (NO in step 826), no developing bias voltage is supplied to the developing unit 24.

Unless the elapsed time T1 reaches the certain time VB_ON, the static elimination region of the surface of the photosensitive drum 20 corresponds to the position of the developing unit 24. In this term, no developing bias voltage is supplied to the developing unit 24. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T1 reaches the certain time VB_ON, the charged region of the surface of the photosensitive drum 20 corresponds to the position of the developing unit 24. At this time, the supply of the developing bias voltage with respect to the developing unit 24 is started. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

The detected charging potential L1 is compared with the initial value (charging potential) L0 (step 828). When the charging potential L1 does not agree with the initial value L0 (NO in step 828), a grid bias voltage with respect to the grid 22*a* of the charging unit 22 is controlled in a direction in which the charging potential L1 turns to the initial value L0 (step 829). By the control of the grid bias voltage, a charging output of the charging unit 22 changes. With the change of the charging output, the charging potential L1 detected by the potential sensor 23 changes. The control of the grid bias voltage is repeated until the charging potential L1 detected by the potential sensor 23 agrees with the initial value L0.

When the charging potential L1 detected by the potential sensor 23 agrees with the initial value L0 (YES in step 828), an exposure start signal LD_ON is supplied to an exposure unit 28 from the controller 50, and accordingly the charged region of the surface of the photosensitive drum 20 is exposed (step 830). Moreover, to grasp a detection start timing (step 833) of an exposure potential L3 in this exposure region, and a detection end timing (step 835) of the exposure potential L3, respectively, an elapsed time T3 from the start of the exposure is measured (step 831).

When the detection start timing and the detection end timing of the exposure potential L3 are managed based on the elapsed time T3 from the start of the exposure, the time required for the detection of the exposure potential L3 can be minimized. Accordingly, the size of the exposure region can be reduced in such a manner as to be as small as possible. Since the size of the exposure region can be reduced as much as possible, the amount of the developer attracted to the exposure region can be reduced. Therefore, the developer can be inhibited from being wasted.

When the elapsed time T3 from the exposure start reaches a certain time VL_S or more (YES in step 832), the detection of the exposure potential L3 in the exposure region of the photosensitive drum 20 is started (step 833).

When the elapsed time T3 reaches a certain time VL_E or more (YES in step 834), the detection of the exposure potential L3 is ended (step 835). Moreover, an exposure end signal LD_OFF is supplied to the exposure unit 28 from the controller 50, and the exposure by the exposure unit 28 ends (step 836). Furthermore, the charging unit 22 is turned off (step 837).

Moreover, to grasp a supply stop timing (step 840) of the developing bias voltage, an elapsed time T2 from when the charging unit 22 turns off is measured (step 838).

The elapsed time T2 from when the charging unit 22 turns off reaches a certain time VB_OFF (YES in step 839), and then the supply of the developing bias voltage with respect to the developing unit 24 is stopped (step 840). Unless the elapsed time T2 reaches the certain time VB_OFF (NO in step 839), the supply of the developing bias voltage to the developing unit 24 is continued.

Unless the elapsed time T2 reaches the certain time VB_OFF, the charged region of the surface of the photosensitive drum 20 corresponds to the position of the developing unit 24. In this term, the supply of the developing bias voltage to the developing unit 24 is continued. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

When the elapsed time T2 reaches the certain time VB_OFF, the static elimination region of the surface of the photosensitive drum 20 corresponds to the position of the developing unit 24. At this time, the supply of the developing bias voltage to the developing unit 24 is stopped. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

After the supply of the developing bias voltage to the developing unit 24 is stopped, the rotation of the photosensitive drum 20 is stopped (step 841), and the static eliminator unit 21 is turned off (step 842).

Moreover, the detected exposure potential L3 is compared with a predetermined set value Ln3 (step 843).

When the exposure potential L3 is not less than the set value Ln3 (YES in step 843), it is judged that the lifetime of the photosensitive drum 20 has expired, and this effect is displayed in a display 60 (step 844). By this display, the lifetime expiry of the photosensitive drum 20 is notified to the user. The user then asks a serviceman to change the photosensitive drum 20.

When the exposure potential L3 is less than the set value Ln3 (NO in step 843), no thing is displayed judging that the lifetime of the photosensitive drum 20 has not expired.

Figure 32:
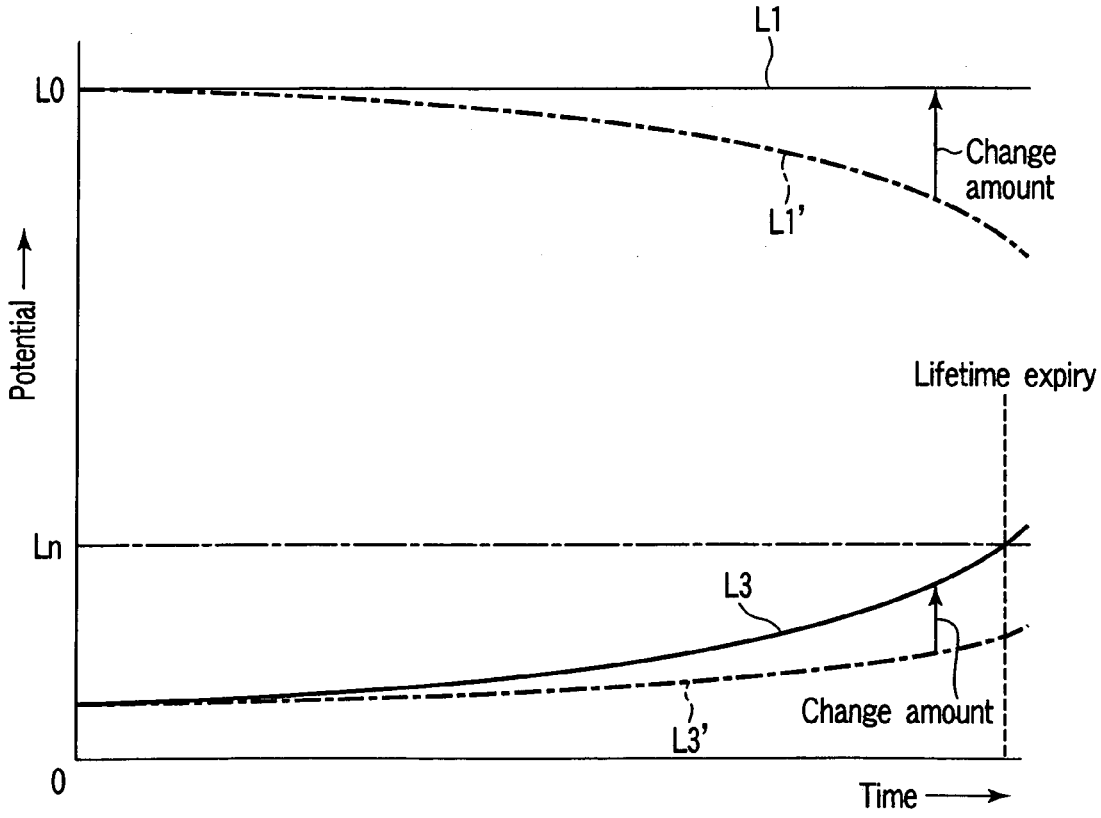
FIG. 32 is a diagram showing changes of the charging potential and the exposure potential in the fourteenth embodiment.

Changes of the charging potential L1 and exposure potential L3 are shown in FIG. 32. L1' denotes a charging potential in a case where any grid bias voltage is not controlled. L3' denotes an exposure potential in a case where the grid bias voltage is not controlled. When the charging potential L1 is controlled into the initial value L0, the exposure potential L3 changes in a rising direction as compared with the exposure potential L3' at a non-control time.

As described above, the first charging potential L0 at the time when the new photosensitive drum 20 has been set is stored as the initial value. Thereafter, the charging output of the charging unit 22 is feedback-controlled in such a manner that the charging potential L1 turns to the initial value L0, and the exposure potential L3 after the feedback control is used in judging the lifetime of the photosensitive drum 20. When the value of the exposure potential L3 is simply seen, the lifetime of the photosensitive drum 20 can be quickly and exactly judged.

[15] A fifteenth embodiment of the present invention will be described.

The constitution is the same as that of the first embodiment.

Figure 33:
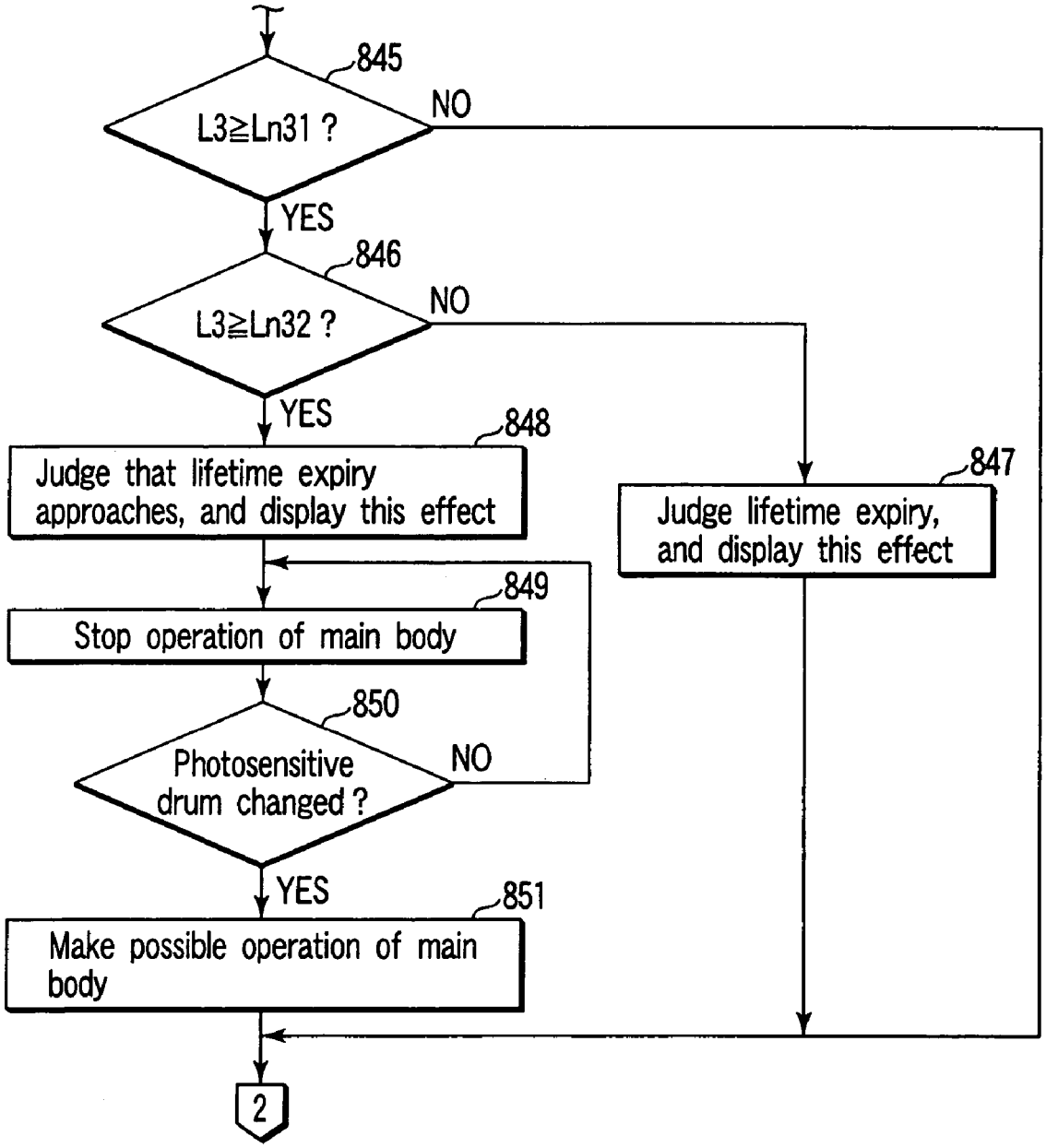
FIG. 33 is a flowchart showing a main part of a function of a fifteenth embodiment.

Instead of the process of steps 843 and 844 of the fourteenth embodiment, a process of steps 845 to 851 shown in a flowchart of FIG. 33 is executed. Since other processes are the same as those of the fourteenth embodiment, the description is omitted.

That is, when the exposure potential L3 is less than a predetermined set value Ln31 (NO in step 845), no thing is displayed judging that the lifetime of the photosensitive drum 20 has not expired.

When the exposure potential L3 is not less than the set value Ln31 (YES in step 845), the exposure potential L3 is compared with a predetermined set value Ln32 (>Ln31) (step 846). When a subtraction result ΔLxy is less than the set value Ln32 (NO in step 846), it is judged that the photosensitive drum 20 has nearly expired, and this effect is displayed in a display 60 (step 847). By this display, it is notified to the user that the lifetime of the photosensitive drum 20 has nearly expired.

The user can recognize in advance that the photosensitive drum 20 approaches a change time. Accordingly, the user can ask a maintenance serviceman to change the photosensitive drum 20 at a convenient timing.

When the exposure potential L3 is not less than the set value Ln32 (YES in step 846), it is judged that the lifetime of the photosensitive drum 20 has expired, and this effect is displayed in the display 60 (step 848). Moreover, the operation of a main body 1 is stopped (step 849). Unless the photosensitive drum 20 is changed (NO in step 850), an operation stop state of the main body 1 is continued.

When the photosensitive drum 20 is changed (YES in step 850), operation of the main body 1 is possible (step 851).

[16] A sixteenth embodiment of the present invention will be described.

The constitution is the same as that of the first embodiment.

Figure 34:
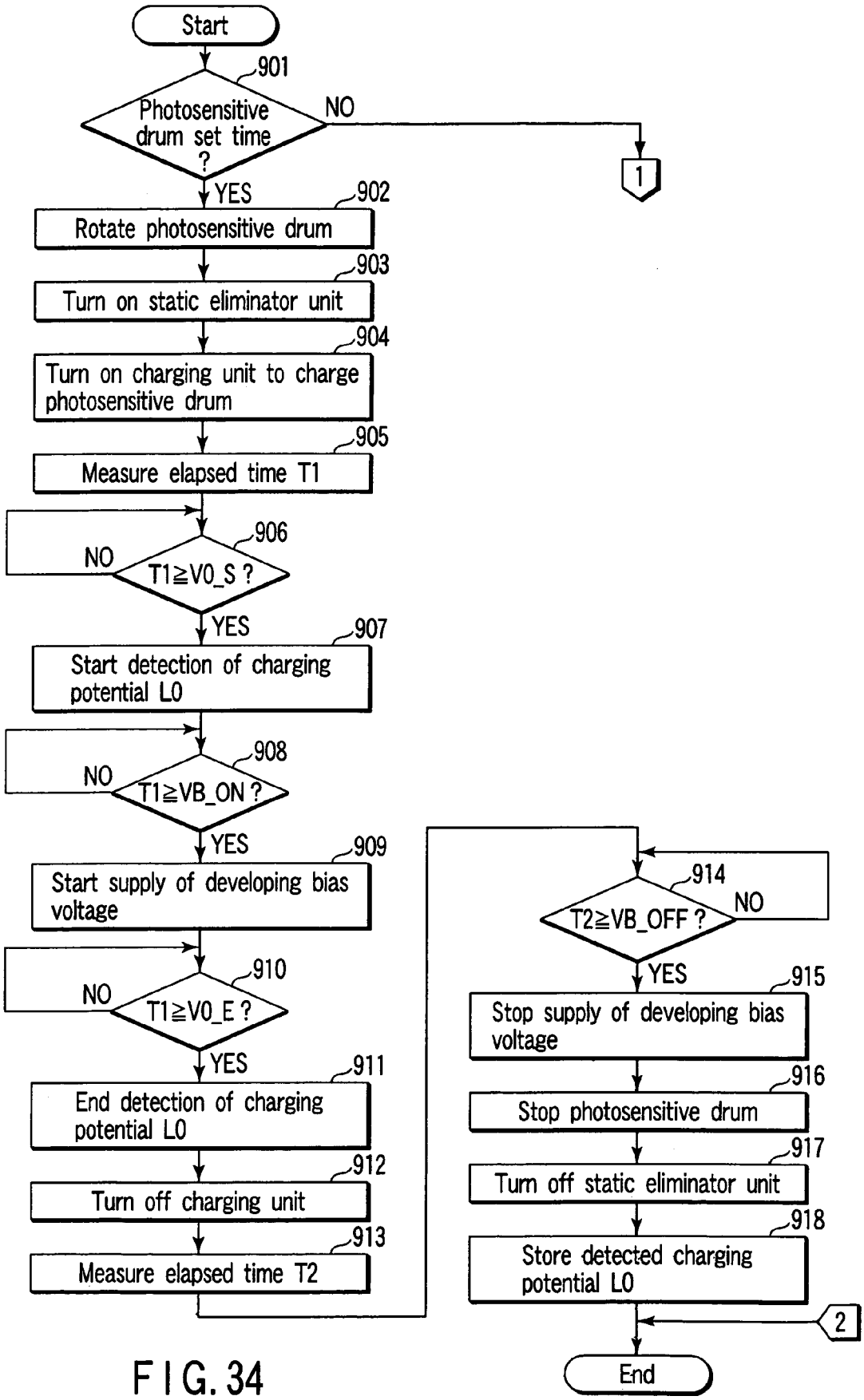
FIG. 34 is a flowchart showing a function of a sixteenth embodiment.
Figure 35:
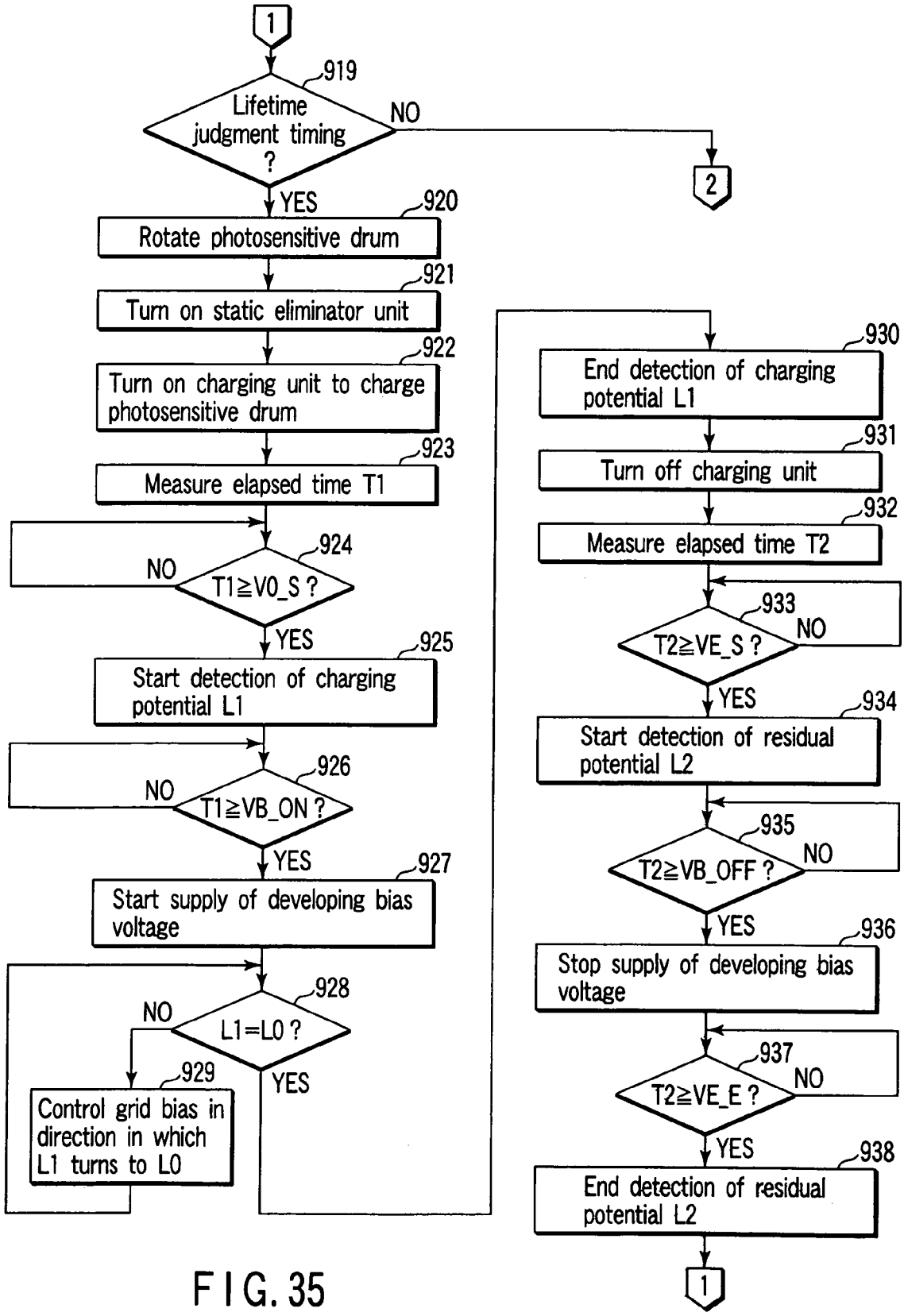
FIG. 35 is a flowchart subsequent to FIG. 34.
Figure 36:
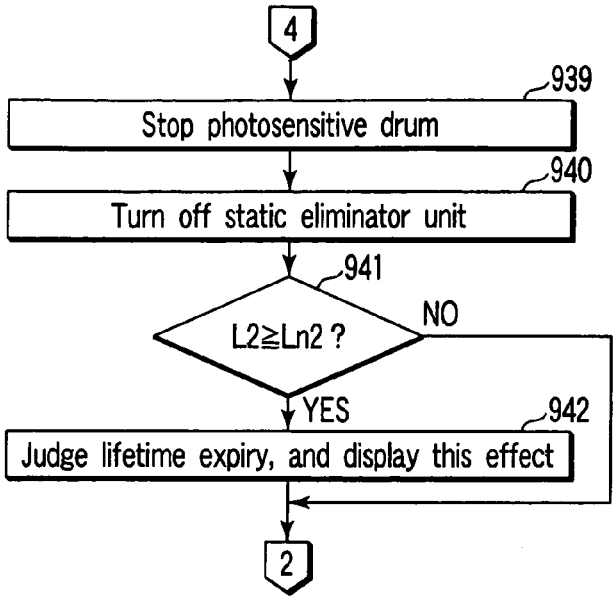
FIG. 36 is a flowchart subsequent to FIGS. 34 and 35.

A function will be described. A lifetime judgment process of a controller 50 is shown in a flowchart of FIGS. 34, 35, and 36.

When a new photosensitive drum 20 is set in a main body 1 at shipping time of the main body 1 or a change time of the photosensitive drum 20 (YES in step 901), rotation of the photosensitive drum 20 is started (step 902), and a static eliminator unit 21 is turned on (step 903). When the static eliminator unit 21 is turned on, electric charges remaining on the surface of the photosensitive drum 20 are eliminated (static elimination). Moreover, a charging unit 22 is turned on. When the charging unit 22 is turned on, a predetermined region of the surface of the photosensitive drum 20 subjected to the static elimination is charged (step 904). To grasp a detection start timing (step 907) of a charging potential L0 in the charged region, a supply start timing (step 909) of a developing bias voltage, and a detection end timing (step 911) of the charging potential L0, respectively, an elapsed time T1 from when the charging unit 22 turns on is measured (step 905).

The elapsed time T1 from when the charging unit 22 turns on reaches a certain time VO_S or more (YES in step 906), and the charging potential L0 of the photosensitive drum 20 is detected by a potential sensor 23 (step 907).

The detection start timing of the charging potential L0 is determined based on the elapsed time T1 from when the charging unit 22 turns on in this manner, and accordingly the charging potential L0 of the charged region can be correctly detected.

The elapsed time T1 from when the charging unit 22 turns on reaches a certain time VB_ON (YES in step 908), and then the supply of the developing bias voltage with respect to a developing unit 24 is started (step 909). Unless the elapsed time T1 reaches the certain time VB_ON (NO in step 908), no developing bias voltage is supplied to the developing unit 24.

Unless the elapsed time T1 reaches the certain time VB_ON, the static elimination region of the surface of the photosensitive drum 20 corresponds to the position of the developing unit 24. In this term, no developing bias voltage is supplied to the developing unit 24. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T1 reaches the certain time VB_ON, the charged region of the surface of the photosensitive drum 20 corresponds to the position of the developing unit 24. At this time, the supply of the developing bias voltage to the developing unit 24 is started. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

The elapsed time T1 from when the charging unit 22 turns on reaches the certain time VO_E or more (YES in step 910), and then the detection of the charging potential L0 by the potential sensor 23 is ended (step 911).

The detection end timing of the charging potential L0 is determined based on the elapsed time T1 from when the charging unit 22 turns on in this manner, and accordingly the detection of the charging potential L0 is securely completed.

When the detection of the charging potential L0 by the potential sensor 23 ends, the charging unit 22 is turned off (step 912). Moreover, to grasp a supply stop timing (step 915) of the developing bias voltage, an elapsed time T2 from when the charging unit 22 turns off is measured (step 913).

The elapsed time T2 from when the charging unit 22 turns off reaches a certain time VB_OFF (YES in step 914), and then the supply of the developing bias voltage with respect to the developing unit 24 is stopped (step 915). Unless the elapsed time T2 reaches the certain time VB_OFF (NO in step 914), the supply of the developing bias voltage to the developing unit 24 is continued.

Unless the elapsed time T2 reaches the certain time VB_OFF, the charged region of the surface of the photosensitive drum 20 corresponds to the position of the developing unit 24. In this term, the supply of the developing bias voltage to the developing unit 24 is continued. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

When the elapsed time T2 reaches the certain time VB_OFF, the static elimination region of the surface of the photosensitive drum 20 corresponds to the position of the developing unit 24. At this time, the supply of the developing bias voltage to the developing unit 24 is stopped. Therefore, no developer (toner and carrier, especially carrier) is attracted by the static elimination region of the surface of the photosensitive drum 20. Therefore, the dirt on the photosensitive drum 20 by the developer can be prevented, and further the developer can be prevented from being wasted.

After the supply of the developing bias voltage to the developing unit 24 is stopped, the rotation of the photosensitive drum 20 is stopped (step 916), and the static eliminator unit 21 is turned off (step 917). Moreover, the detected charging potential L0 is stored as an initial value in an internal memory of the 50 (step 918).

In a periodic lifetime detection timing (YES in step 919), the rotation of the photosensitive drum 20 is started (step 920), and the static eliminator unit 21 is turned on (step 921). When the static eliminator unit 21 is turned on, the electric charge remaining on the surface potential of the photosensitive drum 20 is eliminated (static elimination). The predetermined region of the surface of the photosensitive drum 20 subjected to the static elimination is charged by the charging unit 22 (step 922). Moreover, to grasp a detection start timing (step 925) of a charging potential L1, and a supply start timing (step 927) of the developing bias voltage, respectively, an elapsed time T1 from when the charging unit 22 turns on is measured (step 923).

The elapsed time T1 from when the charging unit 22 turns on reaches a certain time VO_S or more (YES in step 924), and the detection of the charging potential L1 of the photosensitive drum 20 is started by the potential sensor 23 (step 925).

The elapsed time T1 from when the charging unit 22 turns on reaches a certain time VB_ON (YES in step 926), and then the supply of the developing bias voltage with respect to the developing unit 24 is started (step 927). Unless the elapsed time T1 reaches the certain time VB_ON (NO in step 926), no developing bias voltage is supplied to the developing unit 24.

Unless the elapsed time T1 reaches the certain time VB_ON, the static elimination region of the surface of the photosensitive drum 20 corresponds to the position of the developing unit 24. In this term, no developing bias voltage is supplied to the developing unit 24. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T1 reaches the certain time VB_ON, the charged region of the surface of the photosensitive drum 20 corresponds to the position of the developing unit 24. At this time, the supply of the developing bias voltage with respect to the developing unit 24 is started. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

The detected charging potential L1 is compared with the initial value (charging potential) L0 (step 928). When the charging potential L1 does not agree with the initial value L0 (NO in step 928), a grid bias voltage with respect to the grid 22*a* of the charging unit 22 is controlled in a direction in which the charging potential L1 turns to the initial value L0 (step 929). By the control of the grid bias voltage, a charging output of the charging unit 22 changes. With the change of the charging output, the charging potential L1 detected by the potential sensor 23 changes. The control of the grid bias voltage is repeated until the charging potential L1 detected by the potential sensor 23 agrees with the initial value L0.

When the charging potential L1 detected by the potential sensor 23 agrees with the initial value L0 (YES in step 928), the detection of the charging potential L1 is ended (step 930), and the charging unit 22 is turned off (step 931). Moreover, to grasp a detection start timing (step 934) of a residual potential L2, a supply end timing (step 936) of the developing bias voltage, and a detection end timing (step 938) of the residual potential L2, respectively, an elapsed time T2 from when the charging unit 22 turns on is measured (step 932).

When the elapsed time T2 reaches a certain time VE_S or more (YES in step 933), the residual potential L2 of the photosensitive drum 20 is detected by the potential sensor 23 (step 934).

The detection start timing of the residual potential L2 is determined based on the elapsed time T2 from when the charging unit 22 turns off in this manner, and accordingly the residual potential L2 of the static elimination region can be correctly detected.

The elapsed time T2 from when the charging unit 22 turns off reaches a certain time VB_OFF (YES in step 935), and then the supply of the developing bias voltage with respect to the developing unit 24 is stopped (step 936). Unless the elapsed time T2 reaches the certain time VB_OFF (NO in step 935), the supply of the developing bias voltage to the developing unit 24 is continued.

Unless the elapsed time T2 reaches the certain time VB_OFF, the charged region of the surface of the photosensitive drum 20 corresponds to the position of the developing unit 24. In this term, the supply of the developing bias voltage to the developing unit 24 is continued. Therefore, no developer (toner and carrier, especially carrier) is attracted by the charged region of the surface of the photosensitive drum 20. Therefore, soiling of the photosensitive drum 20 by the developer can be prevented, and further the developer can be prevented from being wasted.

When the elapsed time T2 reaches the certain time VB_OFF, the static elimination region of the surface of the photosensitive drum 20 corresponds to the position of the developing unit 24. At this time, the supply of the developing bias voltage to the developing unit 24 is stopped. Therefore, no developer (toner and carrier, especially carrier) is attracted by the static elimination region of the surface of the photosensitive drum 20. Therefore, soiling of the photosensitive drum 20 by the developer can be prevented, and further the developer can be prevented from being wasted.

When the elapsed time T2 reaches a certain time VE_E or more (YES in step 937), the detection of the residual potential L2 by the potential sensor 23 is ended (step 938).

The detection end timing of the residual potential L2 is determined based on the elapsed time T2 from when the charging unit 22 turns off in this manner, and accordingly the detection of the residual potential L2 is securely completed.

When the detection of the residual potential L2 ends, the rotation of the photosensitive drum 20 is stopped (step 939), and the static eliminator unit 21 is turned off (step 940).

Moreover, the detected residual potential L2 is compared with a predetermined set value Ln2 (step 941).

When the residual potential L2 is not less than the set value Ln2 or more (YES in step 941), it is judged that the lifetime of the photosensitive drum 20 has expired, and this effect is displayed in a display 60 (step 942). By this display, the lifetime expiry of the photosensitive drum 20 is notified to the user. The user then asks a serviceman to change the photosensitive drum 20.

When the residual potential L2 is less than the set value Ln2 (NO in step 941), nothing is displayed judging that the lifetime of the photosensitive drum 20 has not expired.

[17] A seventeenth embodiment of the present invention will be described.

The constitution is the same as that of the first embodiment.

Figure 37:
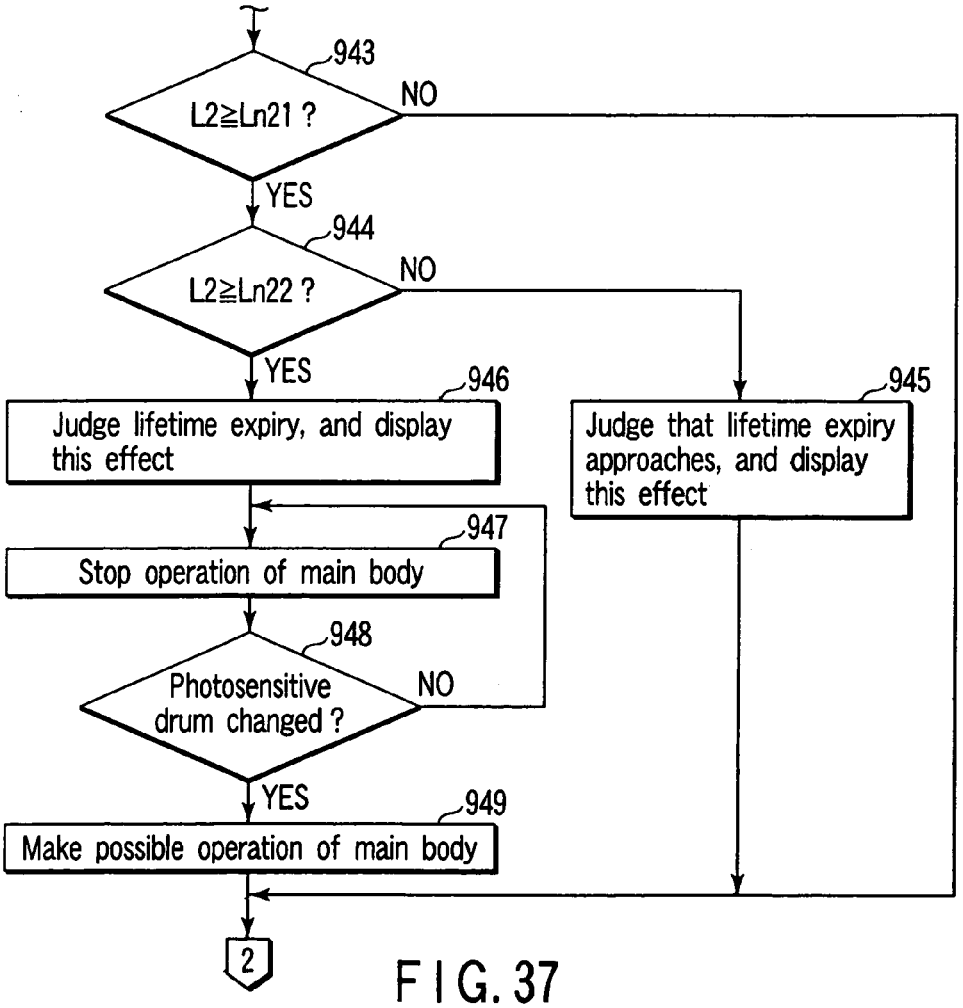
FIG. 37 is a flowchart showing a main part of a function of a seventeenth embodiment.

Instead of the process of steps 941 and 942 of the sixteenth embodiment, a process of steps 943 to 949 shown in a flowchart of FIG. 37 is executed. Since other processes are the same as those of the sixteenth embodiment, the description is omitted.

That is, when the residual potential L2 is less than a predetermined set value Ln21 (NO in step 943), nothing is displayed judging that the lifetime of a photosensitive drum 20 has not expired.

When the residual potential L2 is not less than the set value Ln21 (YES in step 943), the residual potential L2 is compared with a predetermined set value Ln22 (>Ln21) (step 944). When the residual potential L2 is less than the set value Ln22 (NO in step 944), it is judged that the photosensitive drum 20 has nearly expired, and this effect is displayed in a display 60 (step 945). By this display, it is notified to the user that the lifetime of the photosensitive drum 20 has nearly expired.

The user can recognize in advance that the photosensitive drum 20 approaches a change time. Accordingly, the user can ask a maintenance serviceman to change the photosensitive drum 20 at a convenient timing.

When the residual potential L2 is not less than the set value Ln22 (YES in step 944), it is judged that the lifetime of the photosensitive drum 20 has expired, and this effect is displayed in the display 60 (step 946). Moreover, the operation of the main body 1 is stopped (step 947). Unless the photosensitive drum 20 is changed (NO in step 948), the operation stop state of the main body 1 is continued.

When the photosensitive drum 20 is changed (YES in step 948), the operation of the main body 1 is possible (step 949).

[18] It is to be noted that in the above-described embodiments, a case where a photosensitive drum 20 is used as a photosensitive unit has been described, but the present invention may be similarly performed even in a case where a belt-shaped photosensitive unit is used.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. An image forming apparatus comprising:

a photosensitive unit;

a static eliminator unit which eliminates static electricity from a surface of the photosensitive unit;

a charging unit which charges the surface of the photosensitive unit subjected to the static elimination by the static eliminator unit;

an exposure unit which exposes the surface of the photosensitive unit charged by the charging unit;

a developing unit which develops the surface of the photosensitive unit exposed by the exposure unit;

a potential sensor which detects a residual potential of the surface of the photosensitive unit subjected to the static elimination by the static eliminator unit, a charging potential of the surface of the photosensitive unit charged by the charging unit, and an exposure potential of the surface of the photosensitive unit exposed by the exposure unit;

detection means for detecting a difference between the charging potential detected by the potential sensor and the residual potential detected by the potential sensor; and judgment means for judging a lifetime of the photosensitive unit in accordance with the difference detected by the detection means.

2. The apparatus of claim 1, further comprising:

notification means for notifying a judgment result of the judgment means.

3. The apparatus of claim 1, wherein the judgment means judges that the lifetime of the photosensitive unit has expired in a case where the difference detected by the detection means is less than a predetermined set value.

4. An image forming apparatus comprising:

a photosensitive unit;

a static eliminator unit which eliminates static electricity from a surface of the photosensitive unit;

a charging unit which charges the surface of the photosensitive unit subjected to the static elimination by the static eliminator unit;

an exposure unit which exposes the surface of the photosensitive unit charged by the charging unit;

a developing unit which develops the surface of the photosensitive unit exposed by the exposure unit;

a potential sensor which detects a residual potential of the surface of the photosensitive unit subjected to the static elimination by the static eliminator unit, a charging potential of the surface of the photosensitive unit charged by the charging unit, and an exposure potential of the surface of the photosensitive unit exposed by the exposure unit;

detection means for detecting a difference between the charging potential detected by the potential sensor and the residual potential detected by the potential sensor, or a difference between the charging potential detected by the potential sensor and the exposure potential detected by the potential sensor;

judgment means for judging a lifetime of the photosensitive unit in accordance with the difference detected by the detection means; and bias control means for supplying a developing bias voltage to the developing unit, when the surface of the photosensitive unit charged by the charging unit faces the developing unit, and for supplying no developing bias voltage to the developing unit, when the surface of the photosensitive unit subjected to the static elimination by the static eliminator unit faces the developing unit.

5. An image forming apparatus comprising:

a photosensitive unit;

a static eliminator unit which eliminates static electricity from a surface of the photosensitive unit;

a charging unit which charges the surface of the photosensitive unit subjected to the static elimination by the static eliminator unit;

an exposure unit which exposes the surface of the photosensitive unit charged by the charging unit;

a developing unit which develops the surface of the photosensitive unit exposed by the exposure unit;

a potential sensor which detects a residual potential of the surface of the photosensitive unit subjected to the static elimination by the static eliminator unit, a charging potential of the surface of the photosensitive unit charged by the charging unit, and an exposure potential of the surface of the photosensitive unit exposed by the exposure unit;

detection means for detecting a difference between the charging potential detected by the potential sensor and the residual potential detected by the potential sensor, or a difference between the charging potential detected by the potential sensor and the exposure potential detected by the potential sensor; and judgment means for judging a lifetime of the photosensitive unit in accordance with the difference detected by the detection means, wherein the judgment means integrates the difference detected by the detection means, and judges that the lifetime of the photosensitive unit has expired in a case where the integrated value is not less than a predetermined set value.

6. The apparatus of claim 5, further comprising:

integration means for integrating an operation time of the photosensitive unit; and control means for starting the detection of the detection means and the judgment of the judgment means, when the integrated time of the integration means is not less than a predetermined set time.

7. The apparatus of claim 5, further comprising:

control means for periodically executing a process to rotate the photosensitive unit and operate the static eliminator unit while charging a predetermined region of the surface of the photosensitive unit by the charging unit, or a process to rotate the photosensitive unit and operate the static eliminator unit while charging the surface of the photosensitive unit by the charging unit to expose the charged region by the exposure unit, wherein the detection means detects a difference between a charging potential detected by the potential sensor and a residual potential detected by the potential sensor, or a difference between a charging potential detected by the potential sensor and an exposure potential detected by the potential sensor at the time of the execution of the control by the control means.

8. The apparatus of claim 7, further comprising:

notification means for notifying a judgment result of the judgment means.

9. The apparatus of claim 7, wherein the judgment means judges that the lifetime of the photosensitive unit has expired in a case where the difference detected by the detection means is less than a predetermined set value.

10. The apparatus of claim 7, further comprising:

bias control means for supplying a developing bias voltage to the developing unit, when the surface of the photosensitive unit charged by the charging unit faces the developing unit, and for supplying no developing bias voltage to the developing unit, when the surface of the photosensitive unit subjected to the static elimination by the static eliminator unit faces the developing unit.

11. The apparatus of claim 7, wherein the judgment means integrates the difference detected by the detection means, and judges that the lifetime of the photosensitive unit has expired in a case where the integrated value is not less than a predetermined set value.

12. The apparatus of claim 7, further comprising: integration means for integrating an operation time of the photosensitive unit; and control means for starting the periodic process of the control means, when the integrated time of the integration means is not less than a predetermined set time.

* * * * *